US009688066B2

(12) United States Patent
Yamanobe et al.

(10) Patent No.: US 9,688,066 B2
(45) Date of Patent: Jun. 27, 2017

(54) METHOD OF TESTING PRINT HEAD, PRINTING METHOD, DEVICE FOR TESTING PRINT HEAD, AND PRINTER

(71) Applicant: FUJIFILM Corporation, Tokyo (JP)

(72) Inventors: Jun Yamanobe, Kanagawa (JP); Tadashi Kyoso, Kanagawa (JP); Katsuto Sumi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/287,371

(22) Filed: Oct. 6, 2016

(65) Prior Publication Data

US 2017/0021612 A1 Jan. 26, 2017

Related U.S. Application Data

(63) Continuation of application No. PCT/JP2015/063296, filed on May 8, 2015.

(30) Foreign Application Priority Data

May 20, 2014 (JP) ..... 2014-104678

(51) Int. Cl.
*B41J 29/393* (2006.01)
*B41J 2/045* (2006.01)
(Continued)

(52) U.S. Cl.
CPC ..... *B41J 2/0451* (2013.01); *B41J 2/01* (2013.01); *B41J 2/04558* (2013.01);
(Continued)

(58) Field of Classification Search
CPC .... B41J 2/0451; B41J 2/04558; B41J 2/2146; B41J 2/2142; B41J 2/01; B41J 2029/3935
See application file for complete search history.

(56) References Cited

U.S. PATENT DOCUMENTS

2012/0114188 A1* 5/2012 Murase ..... H04N 1/00015 382/112
2014/0375718 A1* 12/2014 Govyadinov ..... B41J 2/0456 347/14

FOREIGN PATENT DOCUMENTS

JP 2009-190281 A 8/2009
JP 2011-051225 A 3/2011
(Continued)

OTHER PUBLICATIONS

International Search Report issued in PCT/JP2015/063296; mailed Jul. 14, 2015.
(Continued)

*Primary Examiner* — Julian Huffman
(74) *Attorney, Agent, or Firm* — Studebaker & Brackett PC

(57) ABSTRACT

A plurality of recording elements included in a printed head are grouped into a plurality of groups, a test order is set in units of groups, and a test of the recording elements is periodically performed in units of groups in the set test order. In a case where an abnormality is detected in the recording element as a result of the test, the recording element in which an abnormality is detected is recognized as a retest target, an order of tests is changed through interruption, and a retest of a group including the recording element recognized as a retest target is performed. In a case where an abnormality is detected again in the recording element that is a retest target as a result of the retest, the recording element that is a retest target is recognized as an abnormal recording element.

16 Claims, 21 Drawing Sheets

(51) Int. Cl.
*B41J 2/21* (2006.01)
*B41J 25/00* (2006.01)
*B41J 2/01* (2006.01)

(52) U.S. Cl.
CPC ..... *B41J 2/2142* (2013.01); *B41J 2/2146* (2013.01); *B41J 2025/008* (2013.01); *B41J 2029/3935* (2013.01)

(56) References Cited

FOREIGN PATENT DOCUMENTS

| | | | |
|---|---|---|---|
| JP | 2012-210768 | A | 11/2012 |
| JP | 2014-004736 | A | 1/2014 |

OTHER PUBLICATIONS

Written Opinion issued in PCT/JP2015/063296; mailed Jul. 14, 2015.

* cited by examiner

METHOD OF TESTING PRINT HEAD, PRINTING METHOD, DEVICE FOR TESTING PRINT HEAD, AND PRINTER

CROSS-REFERENCE TO RELATED APPLICATIONS

This application is a Continuation of PCT International Application No. PCT/JP2015/063296 filed on May 8, 2015, which claims priority under 35 U.S.C §119 (a) to Japanese Patent Application No. 2014-104678 filed on May 20, 2014. Each of the above application(s) is hereby expressly incorporated by reference, in its entirety, into the present application.

BACKGROUND OF THE INVENTION

1. Field of the Invention

The present invention relates to a method of testing a print head, a printing method, a device for testing a print head, and a printer.

2. Description of the Related Art

In a print head in which recording elements are arranged in a line form or a matrix form, if there is an abnormality in the recording elements, image quality defects occur in an image to be printed. For example, in an inkjet type of print head (a liquid (ink) containing a coloring material and a functional material is separated into droplets, and discharged toward a recording target (medium) according to an image signal (print signal) so that the coloring material and the functional material are attached and transferred to the medium), if there is an abnormality such as non-discharge or a discharge direction defect in a nozzle that is the recording element, image defects such as a streak or unevenness occur in an image to be printed.

As a method of testing a state of each recording element included in a print head, a method of testing a state of each recording element by printing a test chart is known. Further, as a method of testing a state of each recording element during execution of a printing job, a method of testing a state of each recording element at any time by printing a test chart in a margin region of paper is known.

JP2014-4736A describes a method of testing a state of each nozzle during execution of a printing job in an ink jet printer that performs color printing using four colors of ink of ink including cyan, magenta, yellow, and black. According to the method described in JP2014-4736A, colors of ink for printing the test chart are switched for each paper, and states of the nozzles are sequentially tested for each color of ink. That is, JP2014-4736A describes a method for testing states of the nozzles sequentially on a certain group basis by switching a combination of nozzles that print a test chart on each paper. According to this method, there is an advantage that a region (a margin region of the paper) necessary to print the test chart can be narrowed. Further, there is an advantage that the amount of data to be processed in one test can be reduced and high-speed processing can be achieved.

SUMMARY OF THE INVENTION

Incidentally, in the method of testing a state of each recording element at any time during the execution of the printing job, erroneous detection often occurs if the print speed increases.

In order to prevent such erroneous detection, even in a case where an abnormality is detected in a certain recording element, it is preferable for an abnormal recording element to be recognized in a case where an abnormality is detected twice instead of an abnormal recording element being recognized immediately.

However, if this method is applied to the method described in JP2014-4736A, that is, the method of testing the state of each recording element sequentially in units of groups, there is a disadvantage that it takes time to detect an abnormality due to an interval between a first test and a second test.

The present invention has been made in view of the circumstances, and an object thereof is to provide a method of testing a print head, a printing method, a device for testing a print head, and a printer which are capable of accurately detecting an abnormality of a recording element in a short period of time.

Means for solving the problem is as follows.

[1] A method of testing a print head comprising a plurality of recording elements, the method comprising: grouping the plurality of recording elements into a plurality of groups, and setting a test order of the plurality of recording elements in units of groups; periodically performing testing of the plurality of recording elements in units of groups in the set test order; recognizing a recording element in which an abnormality is detected, as a retest target, in a case where an abnormality is detected in at least one recording element among the plurality of recording elements in the testing; performing a retest of at least a recording element that is a retest target through interruption before a test to be performed in a test order before a change by changing the test order in a case where a recording element that is a retest target is recognized; and recognizing a recording element that is a retest target as an abnormal recording element in a case where an abnormality is detected again in a recording element that is a retest target as a result of the retest.

In this aspect, the plurality of recording elements comprised in the print head are grouped into a plurality of groups, the test order (an order of tests) is set in units of groups, and testing of recording elements is periodically performed in units of groups in the set test order. In a case where an abnormality is detected in a recording element as a result of the test, the recording element in which an abnormality is detected is recognized as a retest target. In a case where the recording element that is a retest target is recognized, the test order is changed, and a retest of at least the recording element that is a retest target is performed before a test to be performed in a test order before a change. That is, the retest is performed before a test of a recording element (a recording element that is a retest target) is performed next in a normal test order (a set test order). In a case where an abnormality is detected again in the recording element that is a retest target as a result of the retest, the recording element that is a retest target is recognized as an abnormal recording element. Accordingly, it is possible to prevent erroneous detection and accurately detect an abnormal recording element. Further, since a normal test cycle (test order) is ignored and the retest is performed through interruption in a case where the retest is performed, it is possible to detect an abnormality in a short period of time.

[2] The method of testing a print head according to [1], further comprising: recognizing the recording element that is a retest target, as a retest target, in a case where an abnormality is not detected again in the recording element that is a retest target as a result of the retest, and performing the retest up to a preset number of times through interruption.

In this aspect, in a case where an abnormality is not detected in the recording element that is a retest target as a result of the retest, the recording element that is a retest target is recognized as the retest target again and the retest is performed up to a preset number of times through interruption. For example, in a case in which an interruption is performed up to twice, in a case where the recording element is determined to be abnormal in a first test and the recording element is determined to be normal in a second test (in a case where no abnormality is detected), a second retest is performed through interruption. Accordingly, it is possible to detect the abnormality of the recording element more accurately.

[3] A method of testing a print head comprising a plurality of recording elements, the method comprising: grouping the plurality of recording elements into a plurality of groups, and setting a test order of the plurality of recording elements in units of groups; periodically performing a test of the plurality of recording elements in units of groups in the set test order; recognizing the recording element in which the abnormality is detected, as a retest target, in a case where an abnormality is detected in at least one recording element among the plurality of recording elements in the test; replacing some of the recording elements in the group to be tested next with the recording element that is a retest target in a case where the recording element that is a retest target is recognized, and performing a retest of the recording element that is a retest target; and recognizing the recording element that is a retest target as an abnormal recording element in a case where an abnormality is detected again in the recording element that is a retest target as a result of the retest.

In this aspect, the plurality of recording elements comprised in the print head are grouped into a plurality of groups, and a test order is set in units of groups, and the recording elements are periodically tested in units of groups in the set test order. In a case where an abnormality is detected in the recording element as a result of the test, the recording element in which an abnormality is detected is recognized as a retest target, some of the recording elements in the group to be tested next are replaced with the recording element that is a retest target, and a retest of the recording element that is a retest target is performed. In a case where an abnormality is detected again in the recording element that is a retest target as a result of the retest, the recording element that is a retest target is recognized as an abnormal recording element. Accordingly, it is possible to prevent erroneous detection and accurately detect an abnormal recording element. Further, it is possible to detect an abnormality in a short period of time. Since some of the recording elements in the group to be tested next are replaced with the recording element that is a retest target, and the recording element that is a retest target is retested, it is possible to prevent a delay of the test of the next group. That is, since recording elements that have been not replaced can be tested in a normal cycle, it is possible to prevent a delay of the test of the recording elements that have been not replaced.

[4] The method of testing a print head according to [3], further comprising: recognizing the recording element that is a retest target, as the retest target, in a case where an abnormality is not detected again in the recording element that is a retest target as a result of the retest, and performing the retest up to a preset number of times.

In this aspect, in a case where an abnormality is not detected in the recording element that is a retest target as a result of the retest, the recording element that is a retest target is recognized as the retest target again and the retest is performed up to a preset number of times through replacement. For example, in a case in which a retest is performed up to twice, in a case where the recording element is determined to be abnormal in a first test and the recording element is determined to be normal in a second test, a second retest is performed through replacement. Accordingly, it is possible to detect the abnormality of the recording element more accurately.

[5] The method of testing a print head according to any one of [1] to [4], wherein the print head is an ink jet type of print head, the recording element is a nozzle included in the print head, and the abnormal recording element is recognized as an abnormal nozzle.

In this manner, nozzles included in an inkjet type of print head are tested.

[6] The method of testing a print head according to [5], wherein the test and the retest are performed by discharging ink from the nozzle to a medium and reading an image printed on the medium.

In this aspect, the test and the retest of the nozzles are performed by discharging ink from the nozzle to a medium and reading an image printed on the medium.

[7] The method of testing a print head according to [5] or 6], wherein the nozzles are grouped for each color of ink discharged from the nozzle.

In this aspect, the nozzles are grouped for each color of ink discharged from the nozzle, and the nozzles are tested in units of groups.

[8] The method of testing a print head according to [7], wherein the print head incorporated into a printer is tested during execution of a printing job.

In this aspect, the print head incorporated into a printer is tested during execution of a printing job. Accordingly, it is possible to detect an abnormality of the recording elements during execution of the printing job.

[9] The method of testing a print head according to [8], wherein the print head is a line head having a width corresponding to a width of a printing medium, the printer prints an image on the medium with a margin in a single pass, and the print head is tested during execution of a printing job by discharging ink to a margin region of the medium.

In this aspect, the nozzles are tested during the execution of the printing job by discharging the ink in the margin region of the medium.

[10] A printing method, comprising: testing a print head using the method of testing a print head according to any one of [5] to [9]; and setting a recognized abnormal nozzle to non-discharge in a case where the abnormal nozzle is recognized, performing non-discharge correction, and printing an image on a medium.

In this aspect, in a case where the abnormal nozzle is detected, the nozzle recognized as an abnormal nozzle is set to non-discharge, non-discharge correction is performed, and an image is printed on a medium.

[11] A device for testing a print head comprising a plurality of recording elements, the device comprising: a test order setting unit that groups the plurality of recording elements into a plurality of groups, and sets a test order of the plurality of recording elements in units of groups; a test unit that periodically performs a test of the plurality of recording elements in units of groups in the test order set by the test order setting unit; a retest target recognition unit that recognizes the recording element in which an abnormality is detected, as a retest target, in a case where an abnormality is detected in at least one recording element among the plurality of recording elements by the test unit; a retest unit that performs a retest of at least the recording element that is a retest target through interruption before a test to be performed in a test order before a change by changing the test order in a case where the recording element that is a retest target is recognized; and an abnormal recording element recognition unit that recognizes the recording element that is a retest target as an abnormal recording element in a case where an abnormality is detected again in the recording element that is a retest target as a result of the retest in the retest unit.

According to this aspect, the plurality of recording elements comprised in the print head are grouped into a plurality of groups, and the test order of the recording element is set in units of groups by the test order setting unit. A test of recording elements is periodically performed in units of groups in the set test order. In a case where an abnormality is detected in the recording element as a result of the test, the recording element in which an abnormality is detected is recognized as a retest target by the retest target recognition unit. In a case where the recording element that is a retest target is recognized by the retest target recognition unit, the retest unit performs the retest of the recording element that is a retest target. In this case, the retest unit changes the test order set by the test order setting unit, and performs a retest of the recording element that is a retest target through interruption before a test to be performed in a test order before a change. That is, the retest of the recording element that is a retest target is performed before a test is performed next in a normal test order (a set test order). In a case where an abnormality is detected again in the recording element that is a retest target as a result of the retest, the recording element that is a retest target is recognized as an abnormal recording element by the abnormal recording element recognition unit. Accordingly, it is possible to prevent erroneous detection and accurately detect an abnormal recording element. Further, since a normal test cycle (test order) is ignored and the retest is performed through interruption in a case where the retest is performed, it is possible to detect an abnormality in a short period of time.

[12] The device for testing a print head according to [11], further comprising: a second retest target recognition unit that recognizes the recording element that is a retest target, as the retest target, in a case where an abnormality is not detected again in the recording element that is a retest target as a result of the retest in the retest unit, wherein the retest unit performs the retest up to the preset number of times through interruption.

According to this aspect, in a case where an abnormality is not detected in the recording element that is a retest target as a result of the retest, the recording element that is a retest target is recognized as a retest target again by the second retest target recognition unit. The retest is performed a preset number of times. Accordingly, it is possible to detect the abnormality of the recording element more accurately.

[13] A device for testing a print head comprising a plurality of recording elements, the device comprising: a test order setting unit that groups the plurality of recording elements into a plurality of groups, and sets a test order of the plurality of recording elements in units of groups; a test unit that periodically performs a test of the plurality of recording elements in units of groups in the test order set by the test order setting unit; a retest target recognition unit that recognizes the recording element in which an abnormality is detected, as a retest target, in a case where an abnormality is detected in at least one recording element among the plurality of recording elements by the test unit; a retest unit that replaces some of the recording elements in the group to be tested next with the recording element that is a retest target in a case where the recording element that is a retest target is recognized, and performing a retest of the recording element that is a retest target; and an abnormal recording element recognition unit that recognizes the recording element that is a retest target as an abnormal recording element in a case where an abnormality is detected again in the recording element that is a retest target as a result of the retest in the retest unit.

According to this aspect, a plurality of recording elements comprised in the print head are grouped into a plurality of groups by the test order setting unit, and the test order of the recording elements is set in units of groups. The test of the recording element is periodically performed by the test unit in the set test order. In a case where an abnormality is detected in the recording element as a result of this test, the recording element in which an abnormality is detected is recognized as a retest target by the retest target recognition unit. In a case where the recording element that is a retest target is recognized in the retest target setting unit, the retest unit replaces some of the recording elements in the group to be tested next with the recording element that is a retest target, and retests the recording element that is a retest target. In a case where an abnormality is detected again in the recording element that is a retest target as a result of the retest, the abnormal recording element recognition unit recognizes the recording element that is a retest target as an abnormal recording element. Accordingly, it is possible to prevent erroneous detection and accurately detect an abnormal recording element. Further, it is possible to detect an abnormality in a short period of time. Since some of the recording elements in the group to be tested next are replaced with the recording element that is a retest target, and the recording element that is a retest target is retested, it is possible to prevent a delay of the test of the next group. That is, since recording elements that have been not replaced can be tested in a normal cycle, it is possible to prevent a delay of the test of the recording elements that have been not replaced.

[14] The device for testing a print head according to [13], further comprising: a second retest target recognition unit that recognizes the recording element that is a retest target, as the retest target, in a case where an abnormality is not detected again in the recording element that is a retest target as a result of the retest in the retest unit, wherein the retest unit performs the retest up to the preset number of times.

According to this aspect, in a case where an abnormality is not detected in the recording element that is a retest target as a result of the retest, the recording element that is a retest target is recognized as a retest target again by the second retest target recognition unit. The retest is performed a preset number of times. Accordingly, it is possible to detect the abnormality of the recording element more accurately.

[15] The device for testing a print head according to any one of claims [11] to [14], wherein the print head is an ink jet type of print head, the recording element is a nozzle comprised in the print head, and the abnormal recording element recognition unit is an abnormal nozzle recognition unit that recognizes the abnormal recording element as an abnormal nozzle.

According to this aspect, nozzles included in an ink jet type of print head are tested.

[16] The device for testing a print head according to [15], wherein the test unit causes ink to be discharged from the nozzle to a medium, and reads an image printed on the medium to test the nozzle, and the retest unit causes ink to be discharged from the nozzle to a medium, and reads an image printed on the medium to retest the nozzle.

According to this aspect, the test in the test unit is performed by causing ink to be discharged from the nozzle to a medium and reading an image printed on the medium. Further, the retest in the retesting unit is performed by causing ink to be discharged from the nozzle to a medium and reading an image printed on the medium.

[17] The device for testing a print head according to [15] or [16], wherein the test order setting unit groups the nozzles for each color of ink discharged from the nozzle, and sets the test order of the nozzles in units of the groups.

According to this aspect, the nozzles are grouped for each color of ink discharged from the nozzle, and the test order of nozzles is set in units of groups.

[18] A printer for printing an image on a medium using an inkjet type of print head comprising a plurality of nozzles, the printer comprising: a device for testing a print head according to any one of [15] to [17], wherein the print head is tested during execution of a printing job.

According to this aspect, the test of the nozzle is performed during the execution of the printing job.

[19] The printer according to [18], wherein the print head is a line head having a width corresponding to a width of a printing medium, the printer prints an image on the medium with a margin in a single pass, and the print head is tested during execution of a printing job by discharging ink to a margin region of the medium.

According to this aspect, the test of the nozzle is performed during the execution of the printing job by discharging ink to the margin region of the medium.

[20] The printer according to [18] or [19], further comprising: a non-discharge correction unit that sets the recognized abnormal nozzle to non-discharge and performs non-discharge correction in a case where the abnormal nozzle recognition unit recognizes the abnormal nozzle.

According to this aspect, in a case where the abnormal nozzle is detected, a nozzle recognized as the abnormal nozzle is set to non-discharge and non-discharge correction is performed.

According to the present invention, it is possible to accurately detect an abnormality of the recording element in a short period of time.

DESCRIPTION OF THE PREFERRED EMBODIMENTS

Hereinafter, embodiments of the present invention will be described in detail with reference to the accompanying drawings.

<<Configuration of Printer>>

Figure 1:
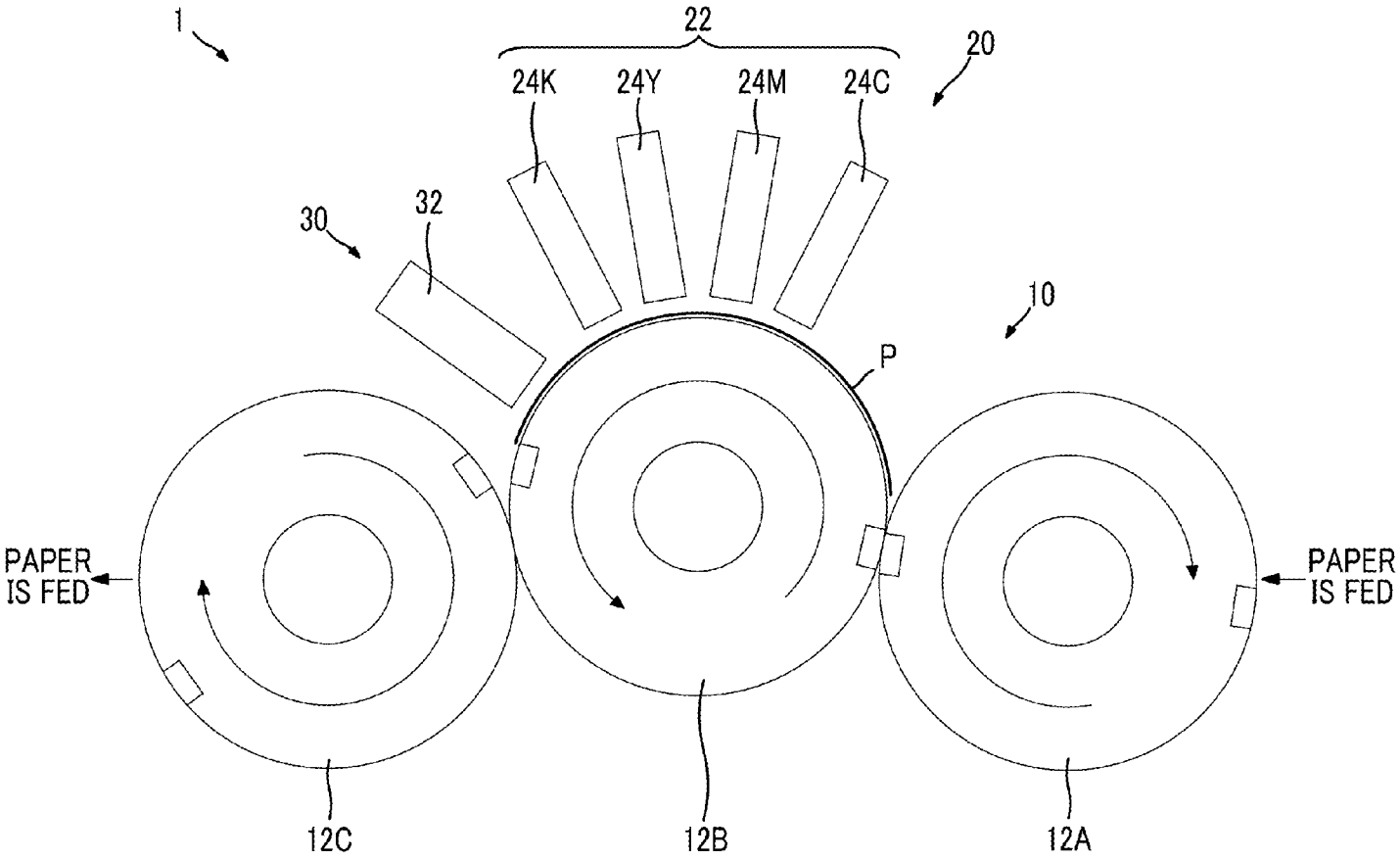
FIG. 1 is a configuration diagram illustrating an embodiment of a printer.

FIG. 1 is a configuration diagram illustrating an embodiment of a printer according to the present invention.

This printer 1 is a color inkjet printer that prints a color image on a sheet (hereinafter referred to as "paper") P as a medium in an ink jet scheme using four colors of ink including cyan, magenta, yellow, and black, and mainly includes a transport unit 10 that transports the paper P along at a certain transport path, a printing unit 20 that prints an image in a single pass on the paper P transported by the transport unit 10, and a reading unit 30 that reads the image printed on the paper P.

<Transport Unit>

The transport unit 10 includes a plurality of drums 12A, 12B, and 12C, and transports the paper P along a certain transport path while passing the paper P from one drum to another drum. Each of the drums 12A, 12B, and 12C transports the paper P by winding and rotating the paper P on a circumferential surface. Each of the drums 12A, 12B, and 12C includes a gripper, grips a leading end of the paper P with this gripper, and holds the paper P on the outer circumferential surface.

The papers P are fed one by one from a paper feeding device (not illustrated) to the transport unit 10. Further, the papers P subjected to printing are sequentially discharged from the drum 12C at a back end to a paper discharge tray (not illustrated).

<Printing Unit>

The printing unit 20 includes a line type of print head (so-called line head) having a width corresponding to a width of the paper P, and discharges the four colors of ink including cyan, magenta, yellow, and black from the print head 22 using an ink jet scheme to print an image on the paper P.

The print head 22 includes a discharge unit 24C that discharges cyan ink, a discharge unit 24M that discharges magenta ink, a discharge unit 24Y that discharges yellow ink, and a discharge unit 24K that discharges black ink.

The respective discharge units 24C, 24M, 24Y, and 24K are arranged at regular intervals on the transport path of the paper P that is transported by the drum 12B. Each of the discharge units 24C, 24M, 24Y, and 24K includes a nozzle surface 26 at a tip thereof, and discharges the ink from the nozzle provided in the nozzle surface 26 to the paper P.

Figure 2:
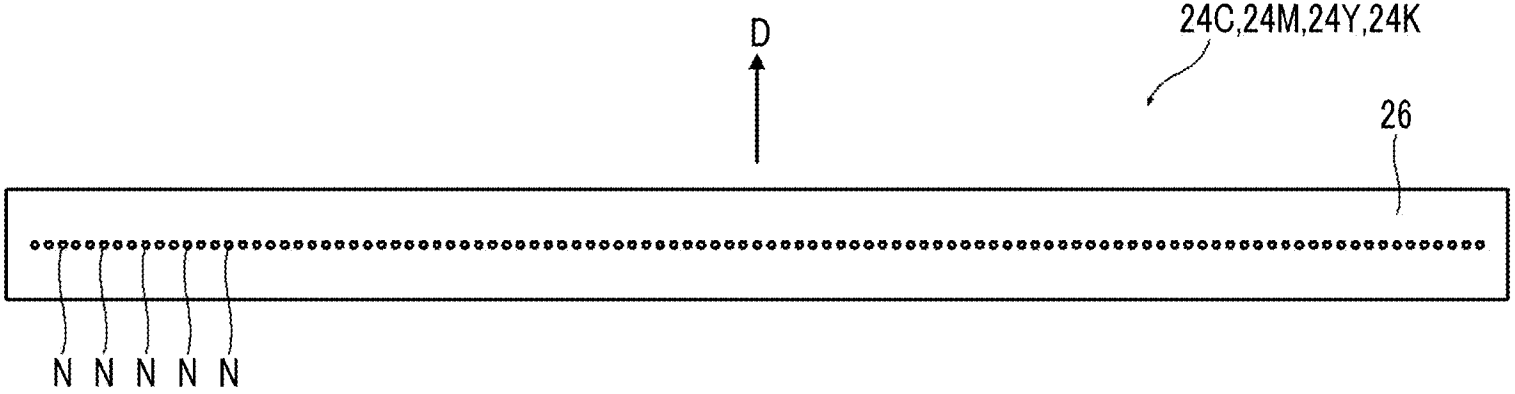
FIG. 2 is a plan view of a nozzle surface.

FIG. 2 is a plan view of the nozzle surface.

As illustrated in FIG. 2, nozzles N are arranged in a line at regular intervals. An arrangement direction of the nozzles N is a direction orthogonal to a transport direction (direction indicated by an arrow D in FIG. 2) of the paper P in the transport unit 10.

<Reading Unit>

The reading unit 30 includes an image scanner 32, and reads the image printed on the paper P by the image scanner 32. The image scanner 32 is disposed on the transport path of the paper P that is transported by the drum 12B, similar to the print head 22.

<<Control System>>

Figure 3:
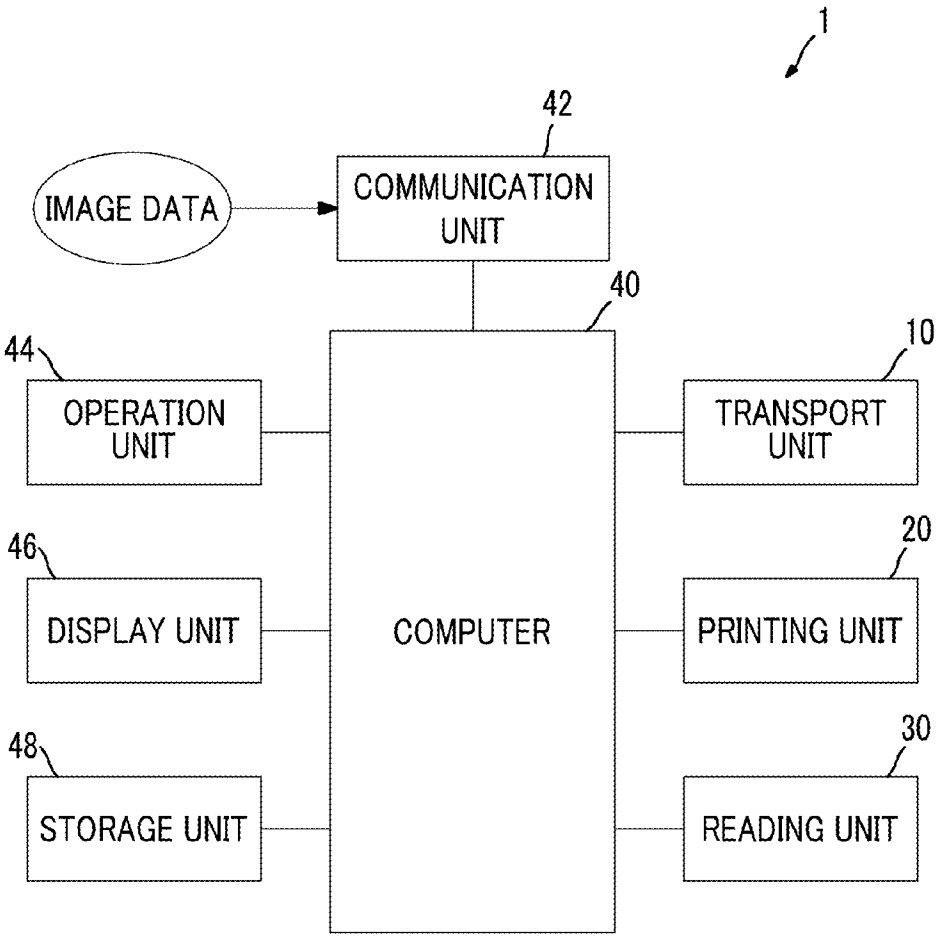
FIG. 3 is a block diagram illustrating a system configuration of a control system of the printer.

FIG. 3 is a block diagram illustrating a system configuration of a control system of the printer.

The printer 1 includes a computer 40. The computer 40 functions as a transport control unit that controls the transport unit 10, a print control unit that controls the printing unit 20, and a reading control unit that controls the reading unit 30 by executing a predetermined control program.

A communication unit 42 for performing communication with an external device, an operation unit 44 for performing an operation of the printer 1, a display unit 46 for displaying various types of information, and a storage unit 48 for storing various types of data, for example, are connected to the computer 40. Image data of an image to be printed by the printer 1 is taken into the computer 40 through the communication unit 42. Further, a control program to be executed by the computer 40, various types of data necessary for control, and the like are stored in the storage unit 48.

Figure 4:
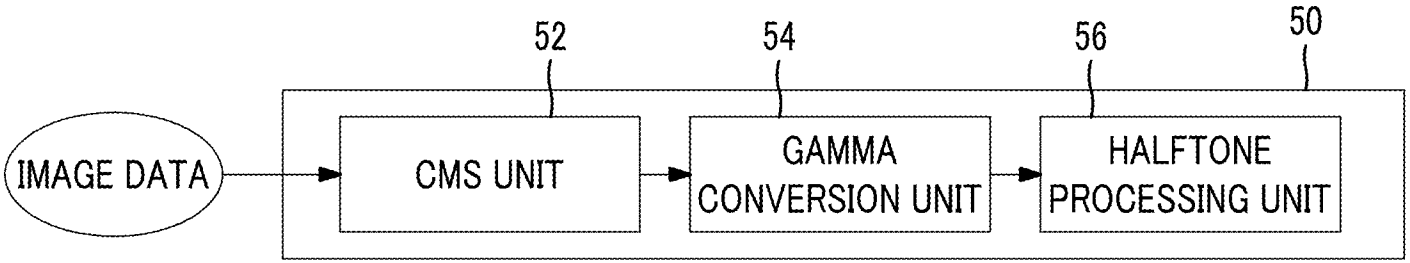
FIG. 4 is a functional block diagram of an image control unit.

The computer 40 functions as an image processing unit 50 by executing a predetermined control program (see FIG. 4). The image processing unit 50 performs predetermined image processing on the image data taken from an external device via the communication unit 42 and performs a process of generating dot data necessary for printing in the printing unit 20.

FIG. 4 is a functional block diagram of the image control unit.

The image processing unit 50 includes a color management system (CMS) unit 52, a gamma conversion unit 54, and a halftone processing unit 56.

The CMS unit 52 performs a color matching process of matching the color with a desired target on input image data, and performs a process for decomposition into four colors including cyan (C), magenta (M), yellow (Y), and black (K) that are ink colors to be used (3-4 conversion (RGB-CMYK) or 4-4 conversion (CMYK-CMYK)). Thus, single color gradation of CMYK is obtained.

The gamma conversion unit 54 performs a calibration process for each color on CMYK image data and performs adjustment of an output characteristic (gamma conversion).

The halftone processing unit 56 performs halftone processing on color data of each color subjected to gamma conversion using an error diffusion method or a dither matrix method, to generate dot data of each color.

Further, the computer 40 functions as a print head test unit 60 for performing test of the print head 22 included in the printing unit 20 by executing a predetermined control program.

Figure 5:
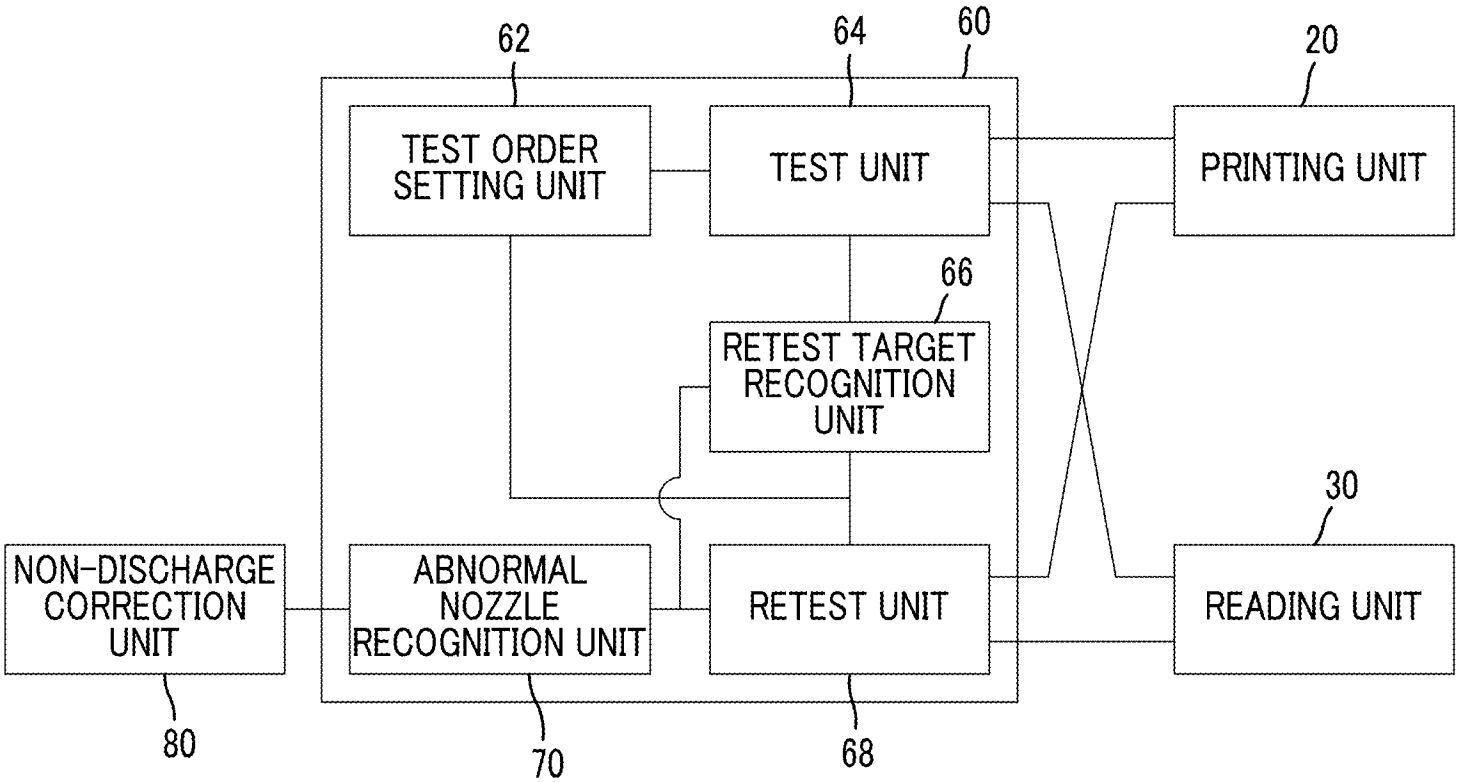
FIG. 5 is a functional block diagram of a print head test unit.

FIG. 5 is a functional block diagram of the print head test unit.

The print head test unit 60 causes the print head 22 to print a predetermined test chart, and tests whether or not there is an abnormal nozzle on the basis of a result of the output. In this case, the plurality of nozzles N included in the print head 22 are grouped into a plurality of groups and the test is performed periodically in units of groups. In order to increase accuracy of the detection, in a case where an abnormality is detected, the retest is performed, and in a case where the abnormality is detected in the retest, the nozzle is recognized as a truly abnormal nozzle. Further, in order for the truly abnormal nozzle to be able to be rapidly detected, when the retest is performed, the retest is performed prior to a test to be performed periodically. That is, an order of the test to be performed periodically is changed and the retest is performed through interruption.

As illustrated in FIG. 5, the print head test unit 60 includes a test order setting unit 62, a test unit 64, a retest target recognition unit 66, a retest unit 68, and an abnormal nozzle recognition unit (abnormal recording element recognition unit) 70. The test order setting unit 62 groups the plurality of nozzles N included in the print head 22 into a plurality of groups, and sets a test order of nozzles N in units of groups. The test unit 64 periodically performs test of the nozzles N in units of groups in the test order set by the test order setting unit 62. If the abnormality is detected in the nozzle N as a result of the test in the test unit 64, the retest target recognition unit 66 recognizes the nozzles N in which the abnormality has been detected, as the retest target. If the nozzle N that is a retest target is recognized, the retest unit 68 performs the retest of the group including the nozzle N that is a retest target through interruption. If the abnormality is detected in the nozzle N recognized as a retest target as a result of the retest in the retest unit 68, the abnormal nozzle recognition unit 70 recognizes the nozzle N recognized as a retest target as an abnormal nozzle (abnormal recording element).

The test order setting unit 62 groups the plurality of nozzles N included in the print head 22 into a plurality of groups, and sets the test order of nozzles N in units of groups. Here, the nozzles N are grouped for each discharge units 24C, 24M, 24Y, and 24K. That is, the nozzles N are grouped for each color of ink to be discharged from the nozzles N, and are grouped for each color of cyan, magenta, yellow, and black. Further, the test order is set to an order of cyan, magenta, yellow, and black, which corresponds to first, second, third, and fourth orders, respectively.

The test unit 64 periodically performs the test of the nozzles N in units of groups in the test order set by the test order setting unit 62. The abnormality of the nozzles N is periodically tested in the order of the discharge unit 24C of cyan, the discharge unit 24M of magenta, the discharge unit 24Y of yellow, and the discharge unit 24K of black.

As described above, the test is performed by causing the print head 22 to print a predetermined test chart 90. The test unit 64 causes the print head 22 to print the predetermined test chart 90, causes the reading unit 30 to read an image of the printed test chart 90, analyzes the obtained image, and tests whether or not there is an abnormality in the nozzle N.

Figure 6:
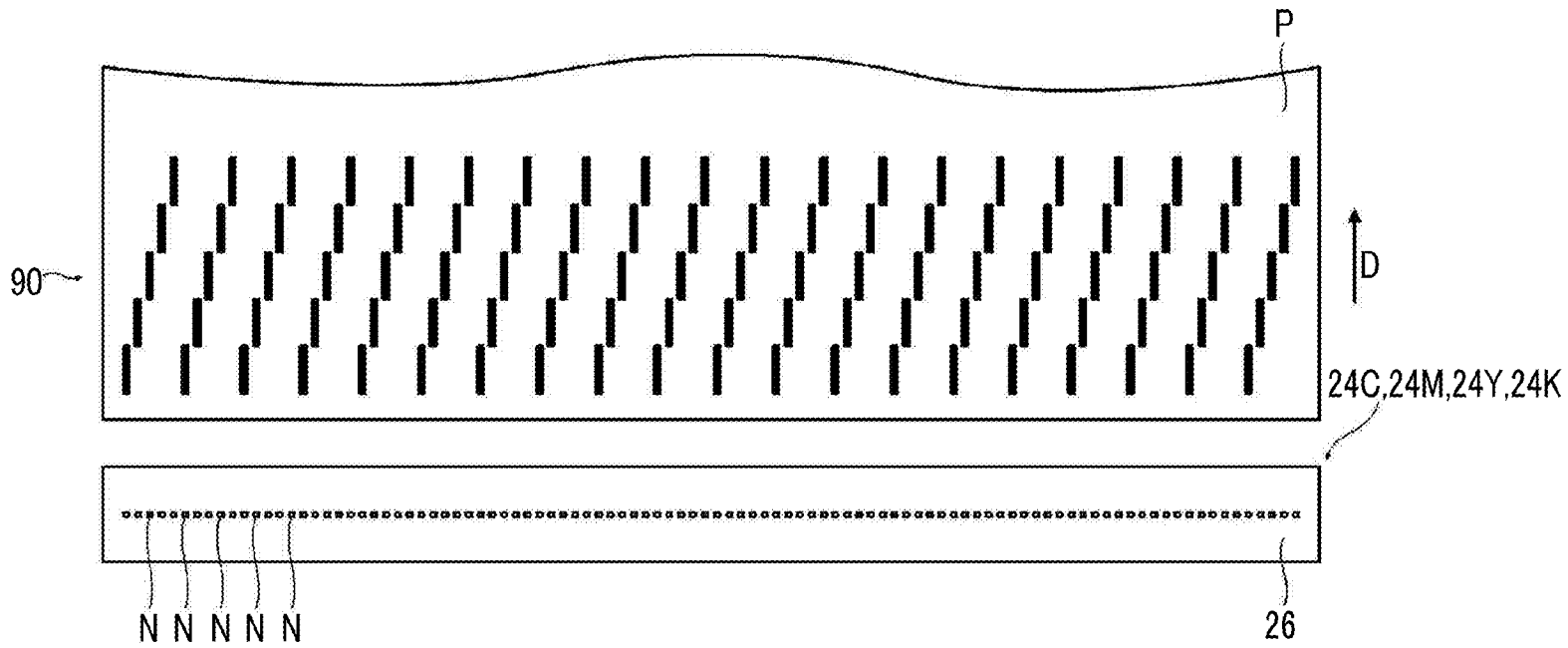
FIG. 6 is a diagram illustrating an example of a test chart.
Figure 7:
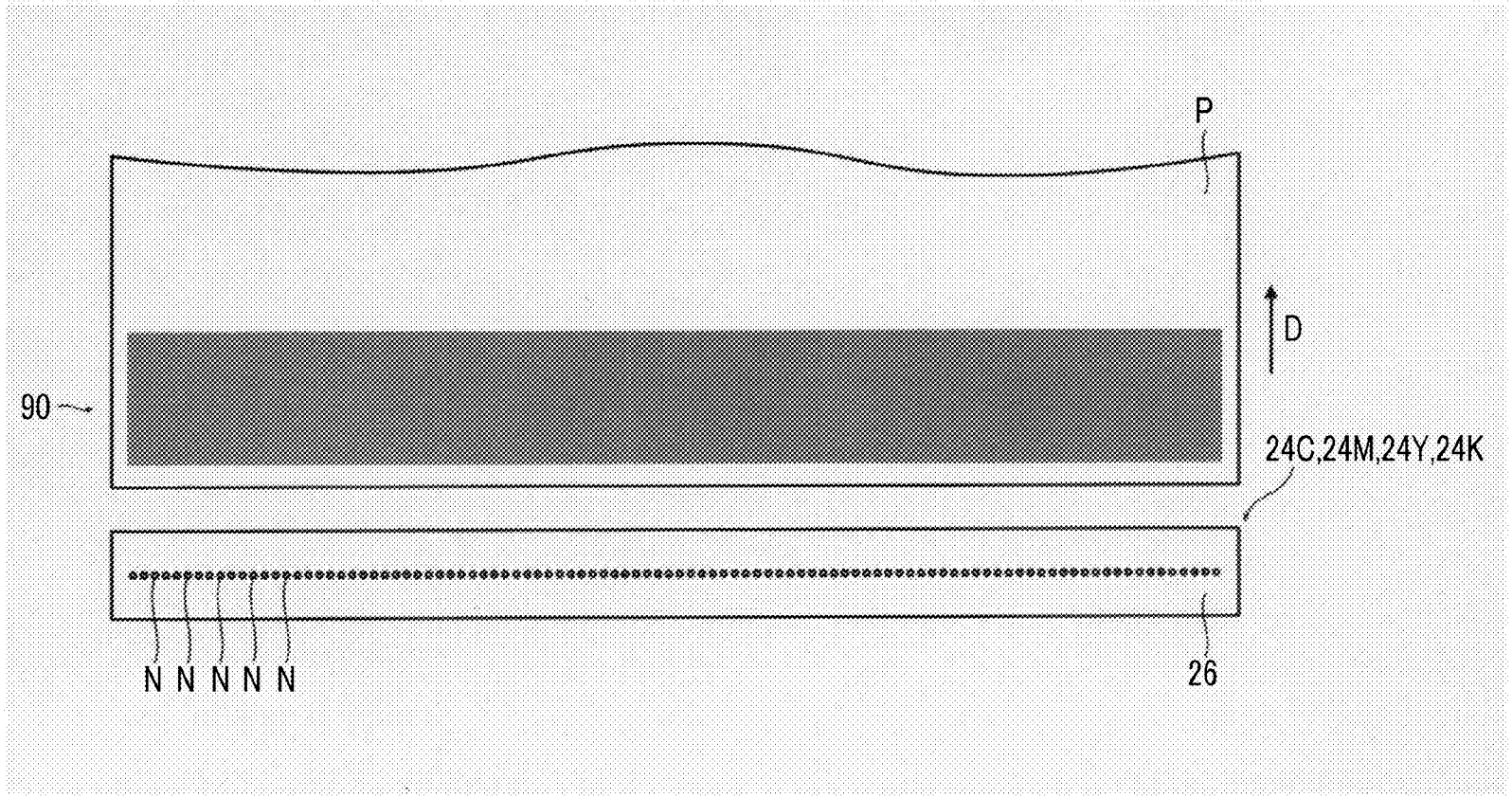
FIG. 7 is a diagram illustrating an example of a test chart.

FIGS. 6 and 7 are diagrams illustrating an example of a test chart. Further, FIGS. 8 and 9 are conceptual diagrams of a method of testing the nozzles using the test chart.

The test chart 90 may be a test chart capable of detecting the abnormality in the nozzle N. For example, a nozzle check pattern (discharge from each nozzle is a droplet formed stepwise) as illustrated in FIG. 6 or an equal concentration patch (a patch at a uniform concentration is a droplet from each nozzle) as illustrated in FIG. 7 may be used. It is possible to detect non-discharge and discharge method failure using the nozzle check pattern illustrated in FIG. 6 or the equal concentration patch illustrated in FIG. 7 as the test chart 90.

Figure 8B:
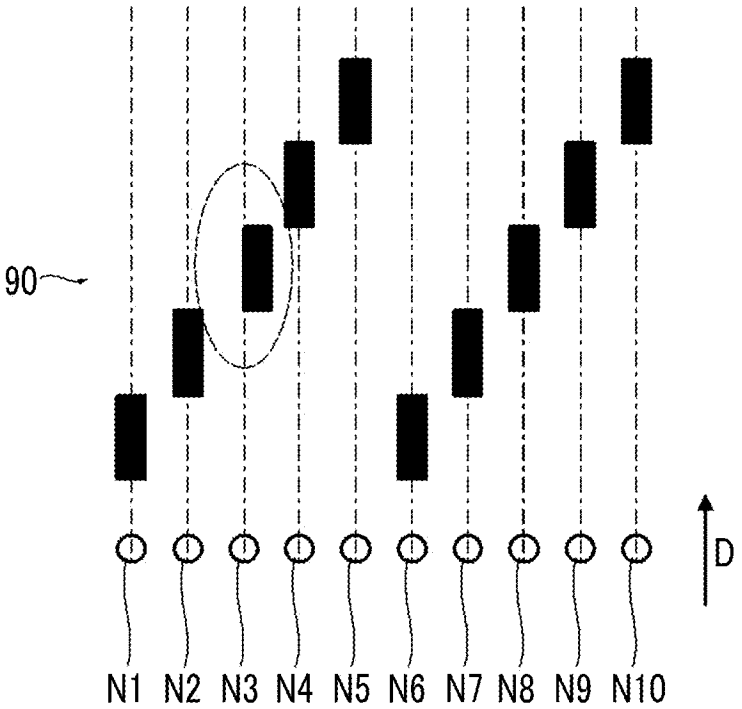
FIGS. 8A and 8B are conceptual diagrams of a method of testing a nozzle using a test chart.
Figure 8A:
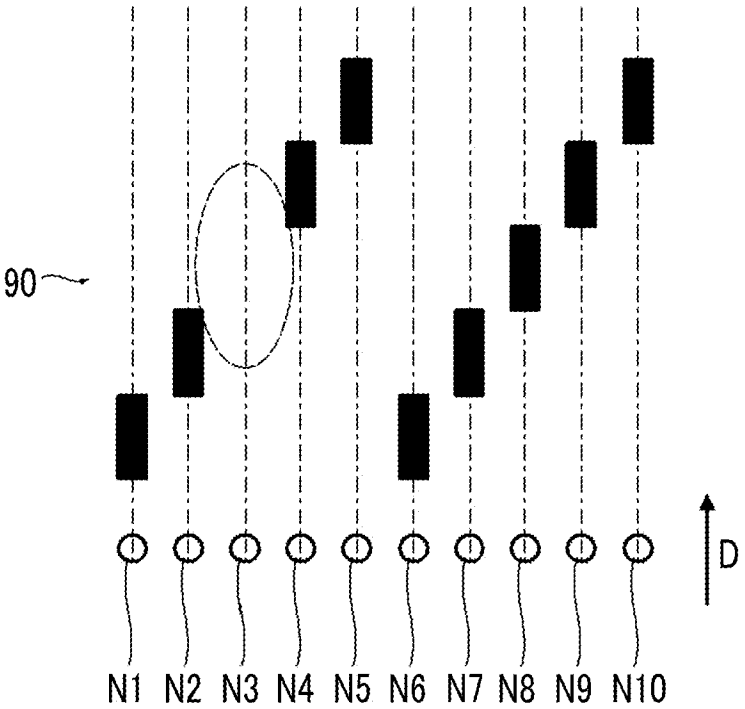

For example, in a case where the nozzle check pattern illustrated in FIG. 6 is used, if the nozzle is set to non-discharge, a pattern of the nozzle set to non-discharge (here, the third nozzle N3 from the left in FIG. 8A) is not printed, as illustrated in FIG. 8A. Therefore, it is possible to detect the nozzle of non-discharge by detecting the pattern that is not printed.

Further, in a case where the nozzle check pattern illustrated in FIG. 6 is used, if discharge direction failure occurs in the nozzle, a pattern of the nozzle in which the discharge direction failure has occurred (here, the third nozzle from the left in FIG. 8B) is shifted from a normal position (a print position when the discharge direction failure has not occurred) and printed, as illustrated in FIG. 8B. Accordingly, it is possible to detect the nozzle in which the discharge direction failure has occurred, by detecting the pattern shifted from the normal position and printed.

Figure 9B:
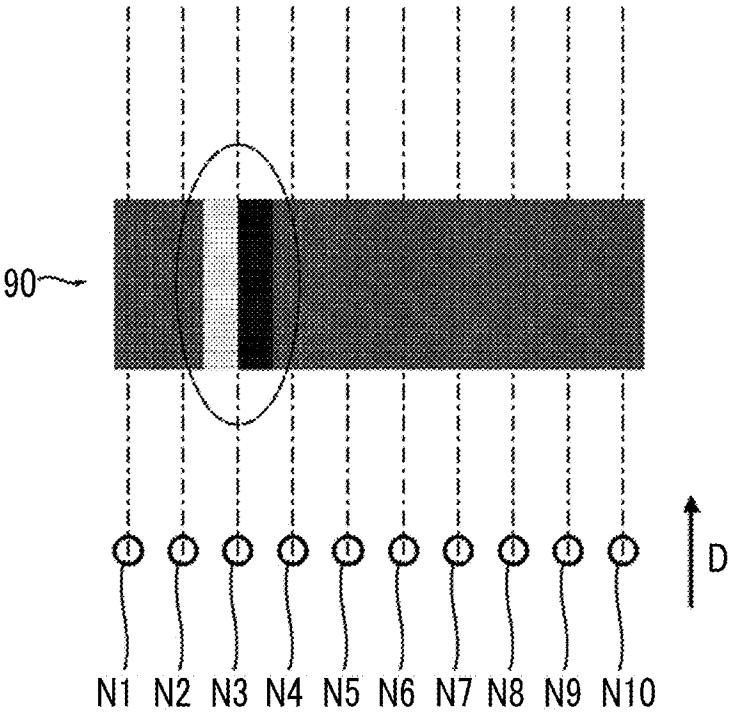
FIGS. 9A and 9B are conceptual diagrams of the method of testing a nozzle using a test chart.
Figure 9A:
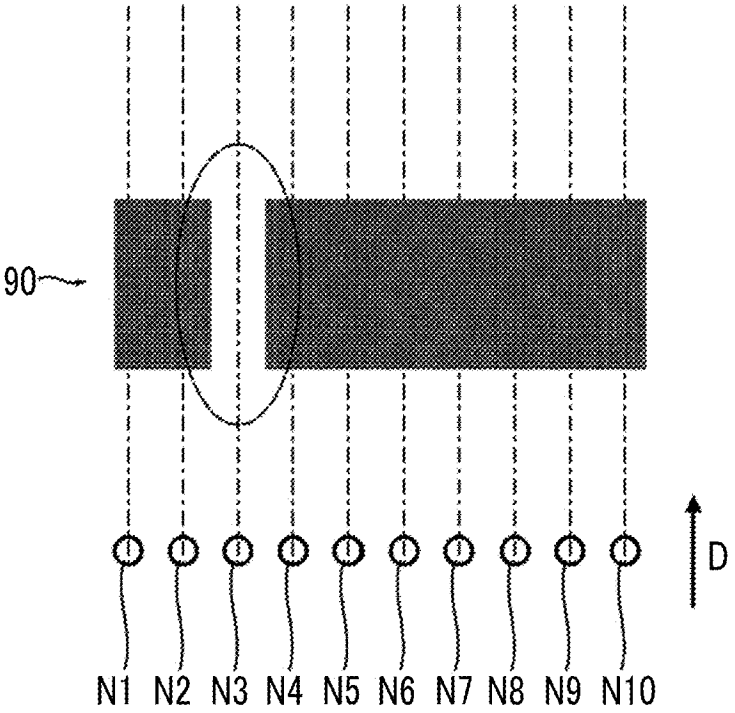

Further, for example, in a case where the patch illustrated in FIG. 7 is used, if the nozzle is set to non-discharge, a portion corresponding to the nozzle set to non-discharge (here, the third nozzle N3 from the left in FIG. 9A) is missing and the patch is printed, as illustrated in FIG. 9A. Therefore, it is possible to detect the nozzle of non-discharge by detecting the missing portion of the printed patch.

Further, in a case where the patch illustrated in FIG. 7 is used, if the discharge direction failure occurs in the nozzle, a concentration in the vicinity of the nozzle in which the discharge direction failure has occurred is changed as illustrated in FIG. 9B (in the example illustrated in FIG. 9B, an example in which a discharge direction of the third nozzle N3 from the left is shifted to the right side (the fourth nozzle N4 side) is shown). Therefore, it is possible to detect the nozzle in which the discharge direction failure occurs, by detecting the portion in which the concentration of the printed patch is changed.

Thus, by printing the predetermined test chart 90, it is possible to detect non-discharge of the nozzle and discharge direction failure. The abnormality of the nozzle N is not limited thereto and a change in volume of discharged ink or a change in speed thereof can be detected as the abnormality.

The retest target recognition unit 66 acquires a result of the test in the test unit 64 and recognizes the nozzle N in which the abnormality has been detected as a retest target. The retest unit 68 and the abnormal nozzle recognition unit 70 are notified of information indicating that the nozzle N that is a retest target has been recognized, and information on the nozzle N that is the recognized retest target.

The retest unit 68 performs the retest of the group including the nozzle N recognized as a retest target on the basis of information from the retest target recognition unit 66. In this case, the normal test order (the test order set by the test order setting unit 62) is changed, and a retest is performed through interruption before test of the group set as the test target in the normal test order.

As described above, in the printer 1 of this embodiment, the test of nozzles N is periodically performed in an order of cyan, magenta, yellow, and black. Thus, for example, when an abnormality is detected in the nozzle N of cyan, retest of the nozzles N of cyan is performed through interruption instead of performing the test of the nozzle N of magenta.

A retest method is the same as the test method in the test unit 64. That is, a predetermined test chart 90 is printed on the print head 22, an image of the printed test chart 90 is read by the reading unit 30, the obtained image is analyzed, and the presence or absence of abnormality in the nozzle N is tested.

The abnormal nozzle recognition unit 70 acquires a result of the retest in the retest unit 68 and determines whether or not the abnormality has been detected again in the same nozzle N (nozzle N recognized as a retest target). If the abnormality is detected again in the same nozzle N, the nozzle N is recognized as an abnormal nozzle.

The computer 40 further functions as a non-discharge correction unit 80 by executing a predetermined control program. If an abnormal nozzle is recognized as a result of the test of the print head 22 in the print head test unit 60, the non-discharge correction unit 80 causes the recognized abnormal nozzle not to discharge (forcibly stops the discharge), and performs non-discharge correction. For the non-discharge correction, a known scheme is available. For example, the non-discharge correction can be performed by performing a process of increasing the amount of discharge from a nozzle around the nozzle caused not to discharge (increasing the number of dots per unit area and increasing the droplet amount).

<<Operation of Printer>>

Next, an operation of the printer 1 of this embodiment configured as above will be described.

<Basic Operation>

First, a basic operation of the printer 1, that is, a method of printing on the paper P will be described.

The printer 1 receives a printing job from an external device (for example, a host computer) and executes the printing job.

If the printing job is received, the image processing unit 50 performs image processing on image data of an image related to the printing job, and generates dot data required for printing. Print processing is actually performed according to an instruction of the printing job. That is, printing of the number of papers specified at the job is performed.

The papers P are periodically fed at regular intervals from a paper feeding device (not illustrated) to the transport unit 10. The transport unit 10 sequentially transports the papers P fed from the paper feeding device along a predetermined transport path. The printing unit 20 discharges ink of each color of cyan, magenta, yellow, and black from the print head 22 to the paper P transported by the transport unit 10 and prints an image on the paper P. The papers P on which the image has been printed are sequentially discharged from the drum 12C at a back end of the transport unit 10 to a paper discharge tray (not illustrated).

Thus, the printer 1 receives the printing job from an external device and executes the printing job.

In a case where the printer 1 receives a plurality of printing jobs, the printer 1 processes the printing jobs in an order of the reception.

<Method of Testing Print Head>

The printer 1 performs the test of the print head 22 using the print head test unit 60 during the execution of the printing job. The print head test unit 60 prints the test chart 90 in a margin region of the paper P to perform the test of the print head 22 during the execution of the printing job. Therefore, printing of an image on the paper P is performed with a margin.

Figure 10:
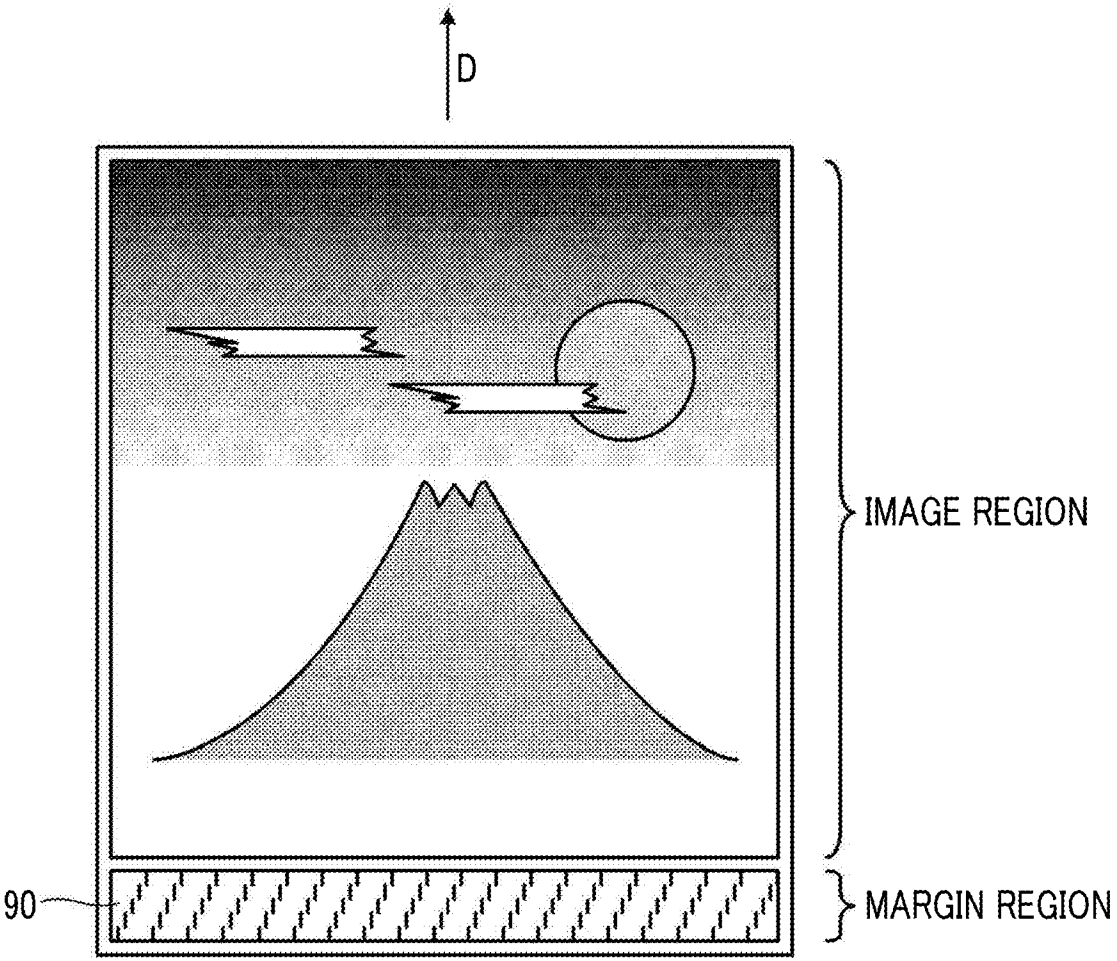
FIG. 10 is a diagram illustrating an example of printing of an image to a paper.

FIG. 10 is a diagram illustrating an example of printing of an image on the paper.

As illustrated in FIG. 10, an image related to the printing job is not printed on an entire surface of the paper P, but printed with a predetermined margin on the back side in a transport direction D of the paper P. The test chart 90 is printed in a margin region on the back side of the image region (area in which the image is printed on the paper).

As described above, the print head test unit 60 sequentially tests the nozzles N included in the print head 22 for each color of ink to be discharged (tests the nozzles in an order of cyan, magenta, yellow, and black).

In this case, the print head test unit 60 tests the nozzles N by switching the color of the ink to be tested for each paper. That is, the test chart of all colors is not printed on one paper P, but a test chart of one color is printed on one paper P, the color of the test chart to be printed on one paper P is sequentially switched, and each nozzle N is tested for each color of ink.

Figure 11:
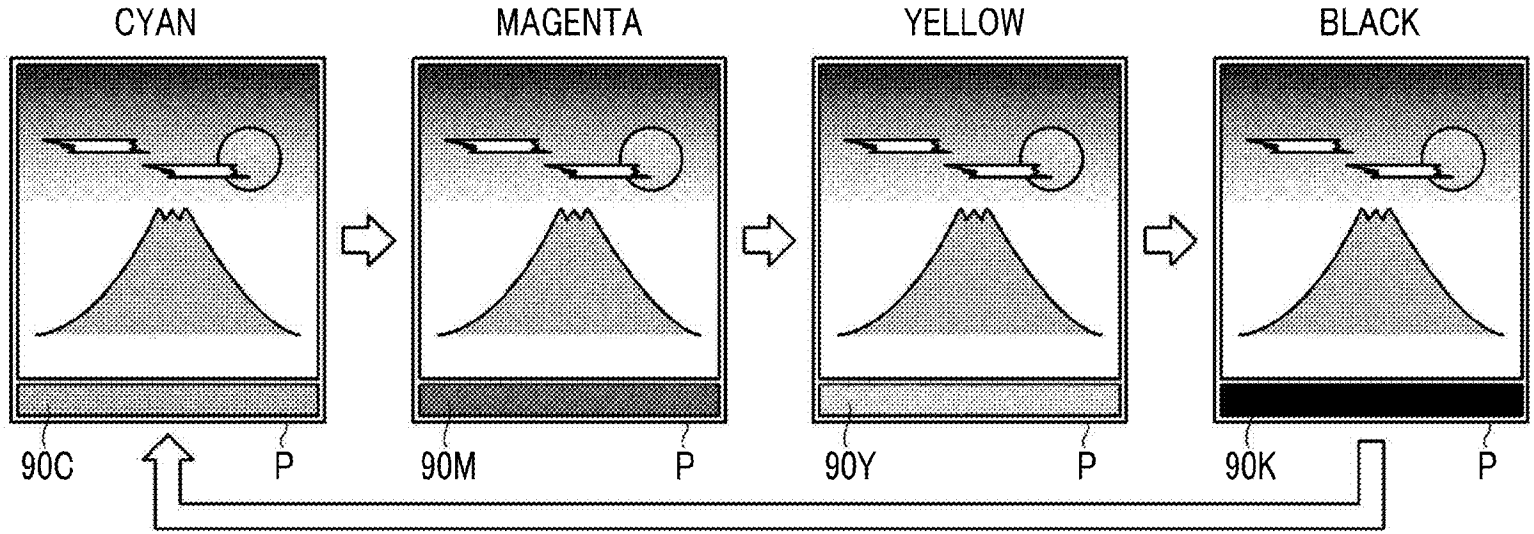
FIG. 11 is a conceptual diagram of test of each nozzle in the print head test unit.

FIG. 11 is a conceptual diagram of a test of each nozzle in the print head test unit.

As illustrated in FIG. 11, the test charts are switched one by one in an order of cyan, magenta, yellow, and black, printing is performed, and the nozzle N of each color is sequentially tested. That is, a test chart 90C of cyan is first printed, a test chart 90M of magenta is then printed, a test chart 90Y of yellow is then printed, and a test chart 90K of black is then printed, and the nozzle N of each color is sequentially tested.

Thus, the print head test unit 60 groups the nozzles N included in the print head 22 for each color, and sequentially performs a test in units of groups. In a case where the print head test unit 60 detects an abnormality, the print head test unit 60 changes the test order, and performs retest on the group to which the nozzle in which the abnormality has been detected belongs through interruption.

Figure 12A:
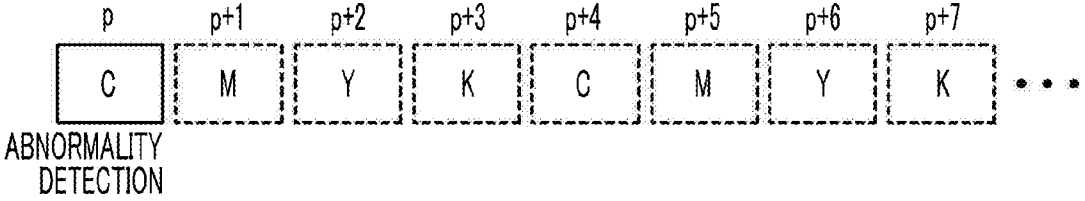
FIGS. 12A to 12C are conceptual diagrams of a retest through interruption.
Figure 12B:
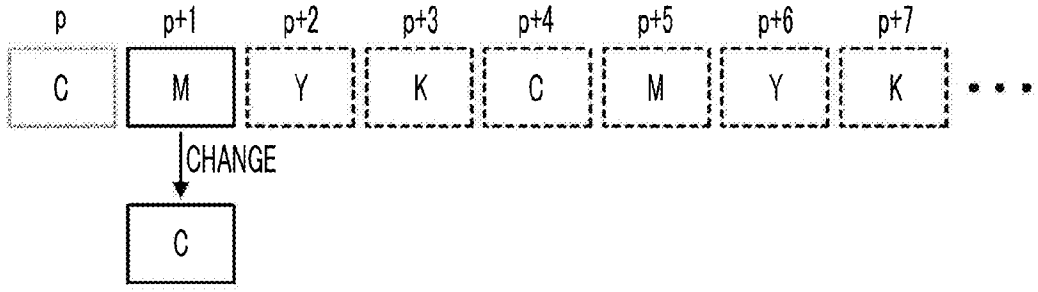
Figure 12C:
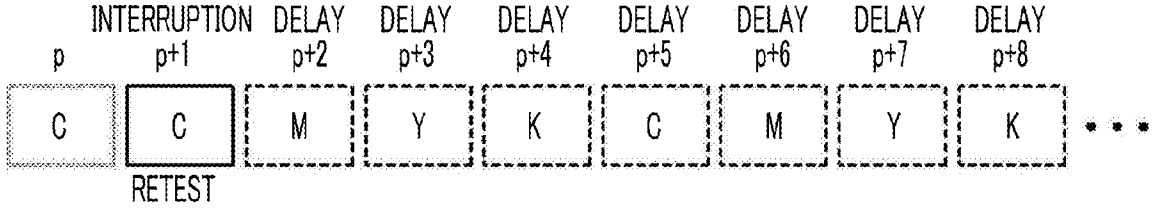

FIGS. 12A to 12C are conceptual diagrams of the retest through interruption.

As illustrated in FIG. 12A, in a case where no abnormality is detected, the test is periodically performed in a test order of cyan (C), magenta (M), yellow (Y), and black (K).

Here, it is assumed that the abnormality has been detected in the nozzle NcX of cyan (C) in the p-th test. If no abnormality is detected, the p+1-th test is a test of the nozzle Nm of magenta (M), whereas if an abnormality is detected in the nozzle NcX of cyan (C) in the p-th test, the p+1-th test is changed to a test of the nozzles Nc of cyan (C), as illustrated in FIG. 12B. That is, the test (retest) of the nozzle Nc of cyan (C) is performed through interruption.

Thus, when the abnormality is detected, test (retest) of the group in which the abnormality has been detected is performed through interruption. As a result, the order of tests can be reclassified so that a test of the nozzle Nm of magenta (M) to be originally performed is performed in the p+2-th test, as illustrated in FIG. 12C.

Thus, the print head test unit 60 tests the nozzles N sequentially for each color (each group), and performs the retest of the nozzles of the color (group) in which the abnormality has been detected, through interruption, when detecting the anomaly. If an abnormality is detected again in the nozzle NcX as a result of the retest, the nozzle NcX is recognized as an abnormal nozzle.

Figure 13:
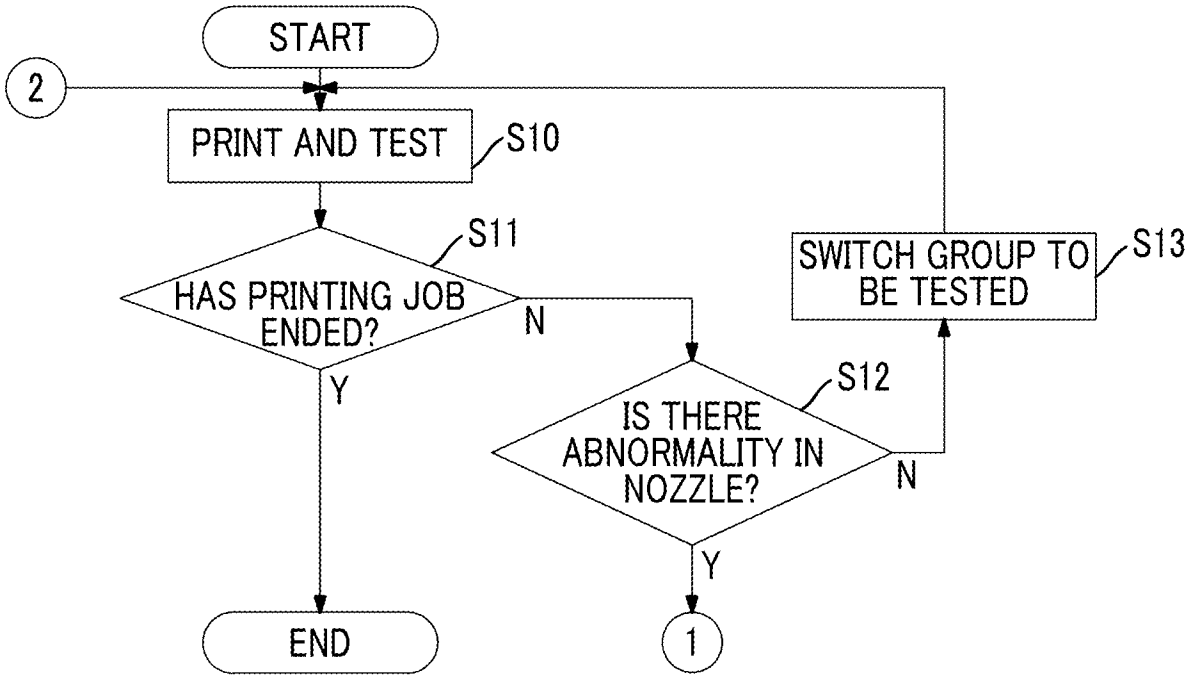
FIG. 13 is a flowchart illustrating a procedure of testing a print head in the print head test unit.
Figure 14:
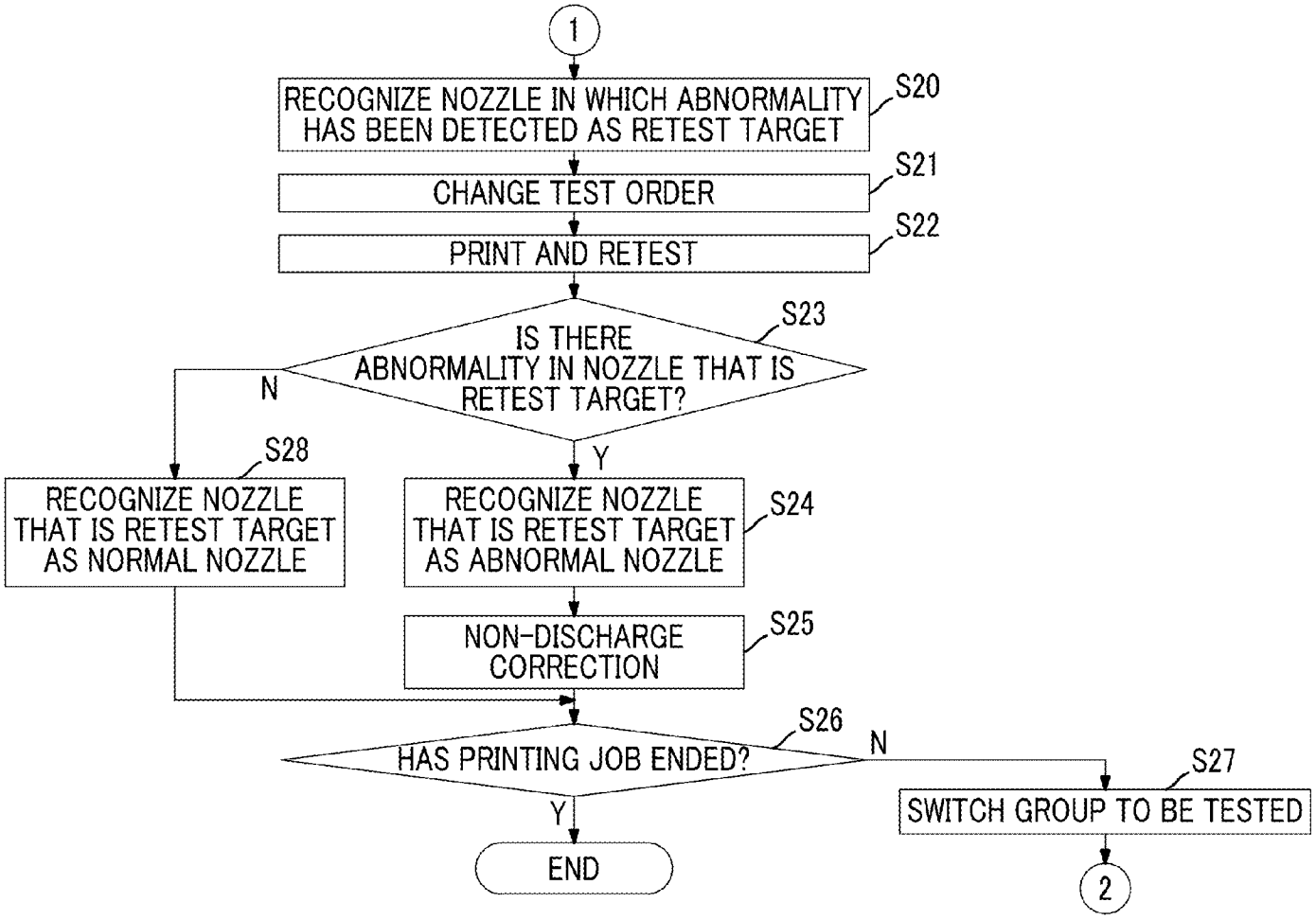
FIG. 14 is a flowchart illustrating the procedure of testing a print head in the print head test unit.

FIGS. 13 and 14 are flowcharts illustrating a procedure of testing the print head in the print head test unit.

First, a test is performed simultaneously with the printing (step S10). That is, the test chart is printed in a margin region of the paper P, and the presence or absence of abnormality in the nozzle is tested on the basis of a result of the printing of the test chart. A test chart with specific color is printed according to a test order.

Then, it is determined whether or not the printing job has ended (step S11). If the printing job is determined to have ended, the process ends.

On the other hand, if the printing job is determined not to have ended (if there is next printing), the presence or absence of abnormality in the nozzle is determined from a test result (step S12).

If it is determined that there is no abnormality in the nozzles N in the tested group (color), switching of the group to be tested is performed (step S13). Test of the switched group is performed (step S10). That is, the test of the next group (color) is performed in a test order. For example, in a case where the test is performed in a test order of cyan, magenta, yellow, and black, when the test of the nozzle of cyan has been performed, the test of the nozzle of the magenta is performed next.

On the other hand, if it is determined that there is an abnormality in the tested nozzle N in the group (color), the nozzle N in which the abnormality has been detected is recognized as a retest target (step S20). The test order is changed so that test (retest) of the group (color) to which the nozzle N recognized as a retest target belongs is performed through interruption (step S21). Thus, the retest of the group (color) to which the nozzle N recognized as a retest target belongs is performed through interruption instead of a test of the group (color) to be originally performed (step S22). For example, in a case where the test is performed in a test order of cyan, magenta, yellow, and black, the nozzle of cyan is tested, and if an abnormality is detected, the test order is changed so that the retest of the nozzle of the cyan is performed through interruption. The retest of the nozzle of cyan performed through interruption.

As a result of the retest, it is determined whether or not there is an abnormality in the nozzle N recognized as a retest target (step S23). That is, it is determined whether or not the abnormality has been detected in the nozzle N recognized as a retest target (nozzle N in which the abnormality has been detected in the previous test).

If it is determined that the abnormality has been detected in the nozzle N that is recognized as a retest target again, the nozzle N that is a retest target (nozzle N in which the abnormality is detected twice consecutively) is recognized as an abnormal nozzle (step S24). When the abnormal nozzle is recognized, the abnormal nozzle enters a non-discharge change, and non-discharge correction is performed (step S25). Thereafter, it is determined whether or not the printing job has ended (step S26), and if the printing job has ended, the process ends. On the other hand, if the printing job has not ended (if there is next printing), switching of a group to be tested is performed (step S27), and the test of the switched group is performed (step S10). That is, test of the next group (color) is performed in a test order.

If it is determined in step S23 that the abnormality is not detected again in the nozzles N recognized as a retest target, the nozzle that is a retest target is determined to be a normal nozzle (step S28). In this case, the previous test is determined to be erroneous detection. Thereafter, it is determined whether or not the printing job has ended (step S26), and in a case where the printing job has ended, the process ends. On the other hand, in a case where the printing job has not ended (in a case where there is next printing), switching of a group to be tested is performed (step S27), and the test of the switched group is performed (step S10). That is, a test of the next group (color) is performed in the test order.

Thus, according to the method of testing a print head of this embodiment, since the nozzle is truly recognized to be an abnormal nozzle (abnormality nozzle) when the same nozzle is determined to be abnormal twice consecutively, it is possible to accurately detect the abnormality of the print head.

Further, since the normal test order is changed and the test of the nozzle that is a retest target is performed through interruption when the retest is performed, it is possible to detect an abnormality at an early stage. Accordingly, it is possible to suppress occurrence of a paper loss.

MODIFICATION EXAMPLE OF METHOD OF TESTING PRINT HEAD

Modification Example 1

Although the retest is performed and the nozzle that is a retest target is determined to be a normal nozzle in a case where no abnormality is detected in the nozzle that is a retest target in the above embodiment, the retest target may be recognized again and the retest may be performed again in a case where no abnormality is detected in the nozzle that is a retest target in the above embodiment.

In this case, the retest to be performed again is also performed through interruption.

Further, the retest to be performed again may be performed a plurality of times. That is, in a case where no abnormality is detected in the retest, the retest may be repeatedly performed up to the preset number of times (end count).

A process of recognizing the nozzle that is a retest target as a retest target again from the result of the retest is performed by the computer 40 executing a predetermined control program. That is, the computer 40 realizes a function as a second retest target recognition unit by executing the predetermined control program.

Figure 15:
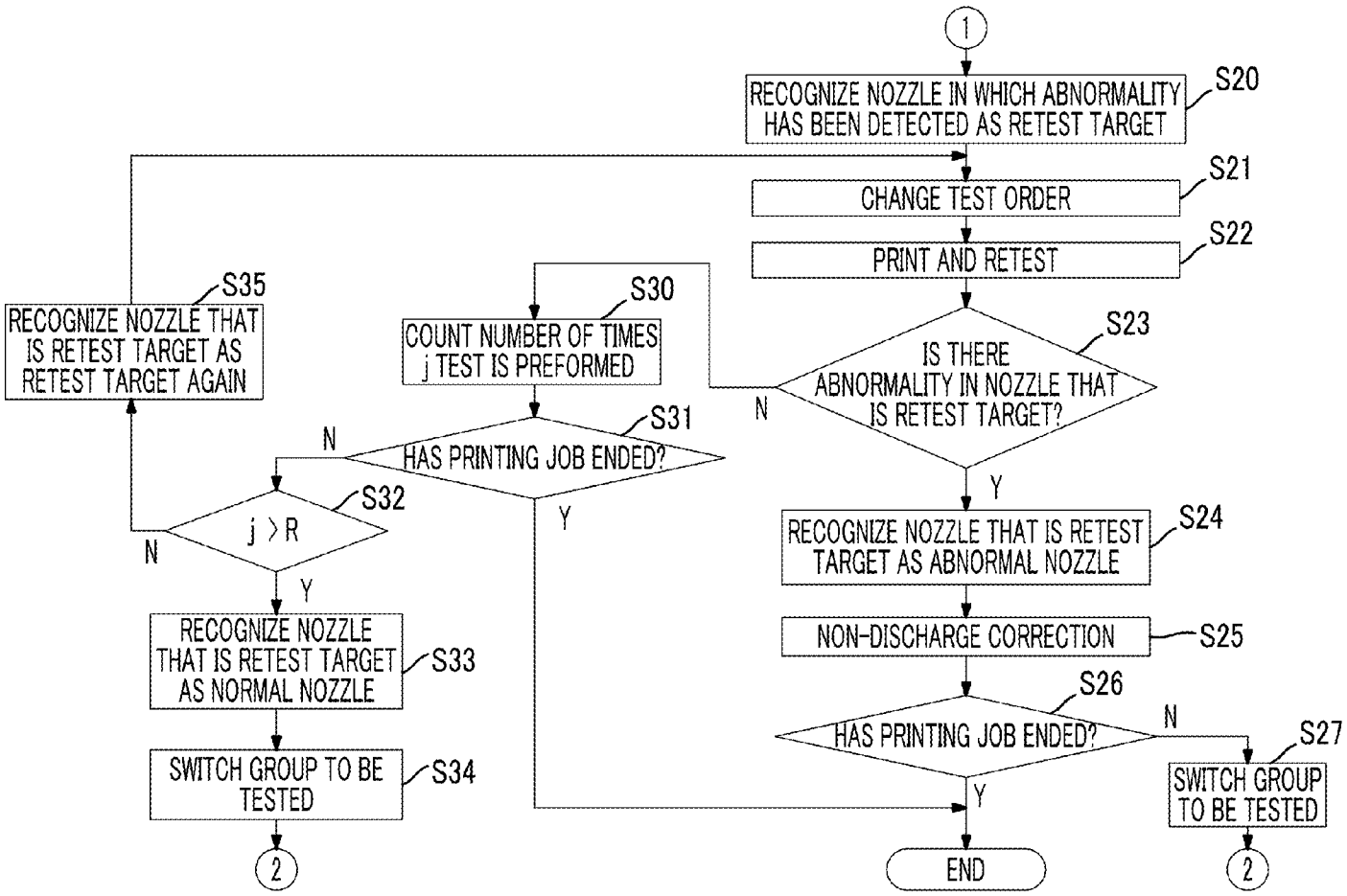
FIG. 15 is a flowchart illustrating a procedure of a process in a case where a retest is performed again in a case where no abnormality is detected in a nozzle that is a retest target in the retest.

FIG. 15 is a flowchart illustrating a procedure of a process in a case where a retest is performed, and the retest is performed again when no abnormality is detected in a nozzle that is a retest target.

If it is determined in step S23 that there is no abnormality in the nozzle that is a retest target, the number of times j the retest is preformed is counted (step S30). The number of times j the retest is preformed is counted up by 1 each time the retest is repeated.

Then, it is determined whether the printing job has ended (step S31). If the printing job is determined to have ended, the process ends.

On the other hand, if the printing job is determined not to have ended (in a case where there is next printing), it is determined whether or not the number of times j the retest is performed exceeds a defined end number R set in advance (step S32). If the end number R is set to 2, the retest is performed twice, and if the end number R is set to 3, the retest is performed up to three times.

If it is determined that the number of times j the retest is performed exceeds the end number R, the nozzle that is a retest target is determined to be a normal nozzle (step S33). In this case, a previous test is determined to be an erroneous detection. Thereafter, switching of the group (color) to be tested is performed (step S34), and the process returns to step S10 in which the test of the nozzles N in the next group (color) is performed (step S10).

On the other hand, if it is determined that the number of times j of the retest is performed does not exceed the end number R, the nozzle N that is the retest target is recognized as the retest target again (step S35). Thereafter, the test order is changed so that the retest of the group (color) to which the nozzle N recognized as the retest target belongs is performed through interruption (step S21). The retest is performed again (step S22). That is, the retest of the group (color) to which the nozzle N recognized as the retest target again belongs is performed through interruption.

Thus, it is possible to more accurately detect the abnormality in the print head by performing the retest again and detecting the presence or absence of an abnormality in the nozzle that is a retest target in a case where there is no abnormality in the nozzle that is the retest target as a result of the retest.

Figure 16:
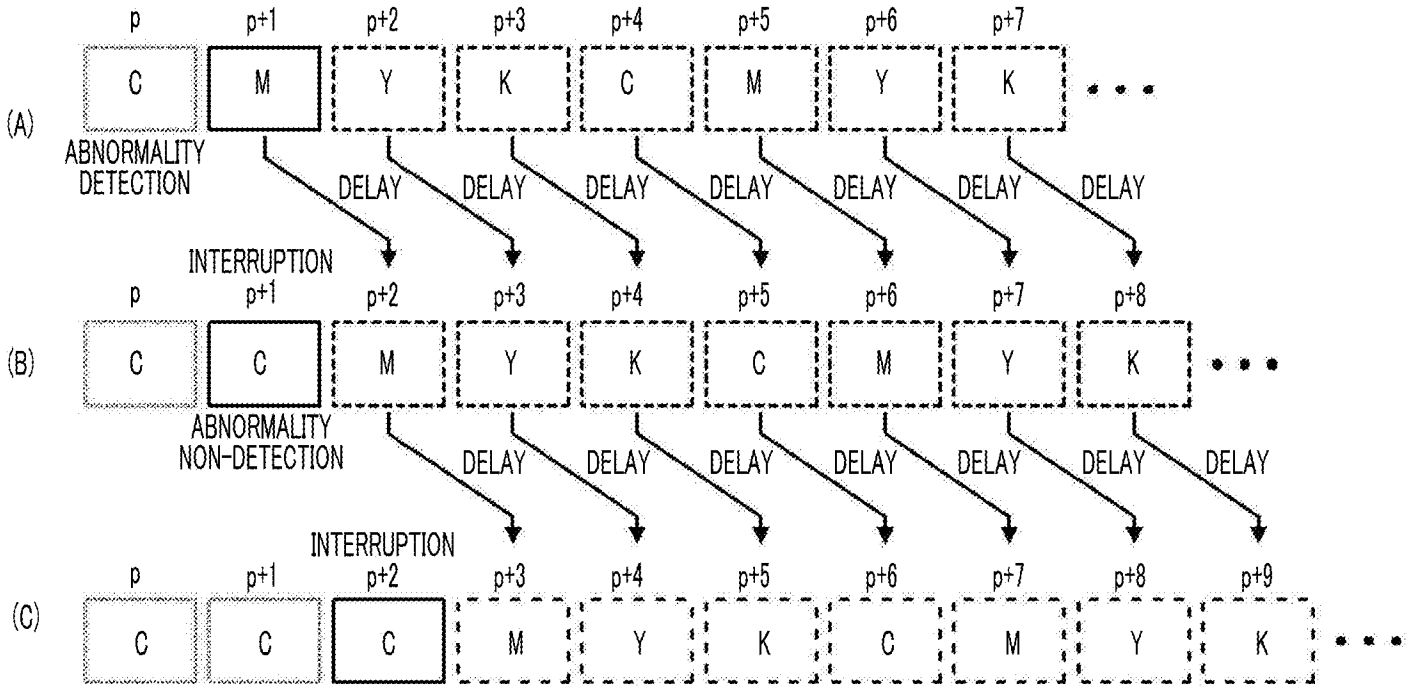
FIG. 16 is a conceptual diagram of test in a case where a retest is performed again in a case where there is no abnormality in the nozzle that is a retest target in the retest.

FIG. 16 is a conceptual diagram of a test in a case where the retest is performed again when there is no abnormality in the nozzle that is a retest target that has been retested.

As illustrated in FIG. 16(A), in a case where no abnormality is detected, a test is periodically repeated in a test order of cyan (C), magenta (M), yellow (Y), and black (K).

Here, it is assumed that an abnormality has been detected in the nozzle NcX of cyan (C) in the p-th test.

If no abnormality is detected, p+1-th test is a test of the nozzle Nm of magenta (M), and if an abnormality is detected in the nozzle NcX of cyan (C) in the p-th test, the p+1-th test is changed to a test of the nozzle Nc of cyan (C), as illustrated in FIG. 16(B). That is, a retest of the nozzles Nc of cyan (C) is performed through interruption. As a result, a test of the nozzle Nm of magenta (M) to be originally performed is deferred once and changed to p+2-th test.

If an abnormality is detected in the nozzle NcX as a result of the retest of the nozzle Nc of cyan (C), the nozzle NcX is recognized as an abnormal nozzle. Thereafter, the test order is returned to the normal test order, and the test is continued. That is, the test of the nozzle Nm of magenta (M) is performed in the p+2-th test, and the test of the nozzle Ny of yellow (Y) is performed in the p+3-th test.

On the other hand, if no abnormality is detected in the nozzle NcX as a result of the retest of the nozzle Nc of cyan (C), the p+2-th test is changed to the test (retest) of the nozzle Nc of cyan (C) again, as illustrated in FIG. 16(C). That is, retest of the nozzle Nc of cyan (C) is performed through interruption again. As a result, the test of the nozzle Nm of magenta (M) to be originally performed is deferred once again and changed to the p+3-th test.

Thus, in a case where abnormality is not detected in the nozzle that is a retest target that has been retested, the retest is repeatedly performed to a defined end number of times. That is, the retest is performed repeatedly until it is consecutively confirmed that there is no abnormality by a defined number of times (=end number of times). Thus, it is possible to detect abnormality of the nozzles more accurately.

Modification Example 2

In the above embodiment, in a case where an abnormality is detected in the nozzle in a normal test (which is not a retest), retest of the entire group including the nozzle in which the abnormality has been detected is performed. That is, for example, in a case where an abnormality is detected in the test of the nozzles of cyan, retest is performed on all nozzles of cyan.

The retest is not necessarily performed on the entire group of the nozzle in which the abnormality has been detected, and may be performed on only the nozzle in which the abnormality has been detected. That is, at least the retest of the nozzle in which the abnormality has been detected may be performed. Thus, for example, the nozzles grouped into each group may be further divided into small groups under the group and the retest may be performed in units of divided small groups.

Figure 17:
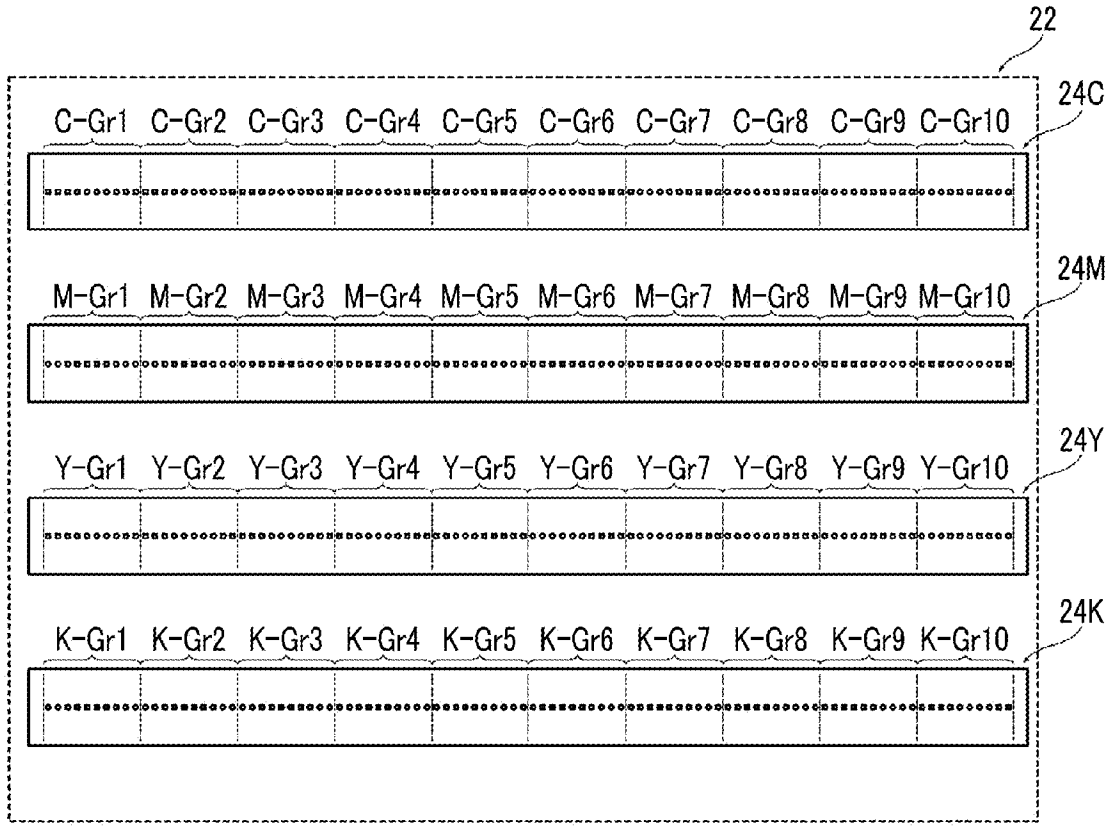
FIG. 17 is a conceptual diagram of grouping of the nozzles.

FIG. 17 is a conceptual diagram of grouping of nozzles.

As illustrated in FIG. 17, the nozzles included in the print head 22 are grouped into groups (large groups) for each of the discharge units 24C, 24M, 24Y, and 24K of cyan, magenta, yellow, and black, that is, for each color, and the nozzles in each group (large group) are grouped into small groups. In the example illustrated in FIG. 17, in each group (large group), the nozzles are equally divided in 10 in a column direction and grouped into 10 small groups.

Figure 18A:
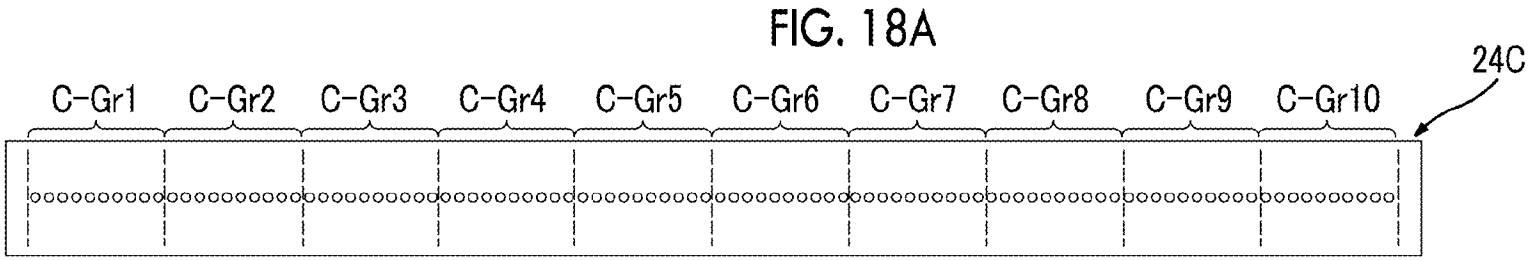
FIGS. 18A to 18C are conceptual diagrams in a case where a retest is performed in units of small groups.
Figure 18B:
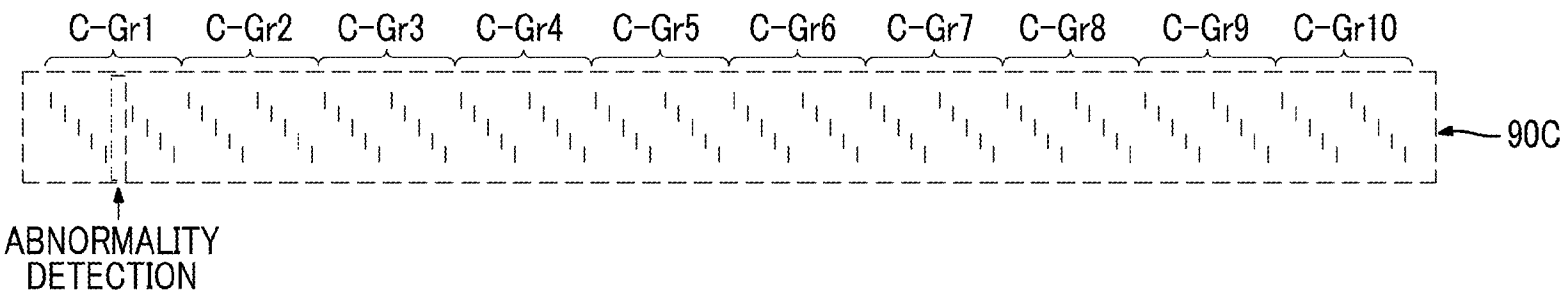
Figure 18C:
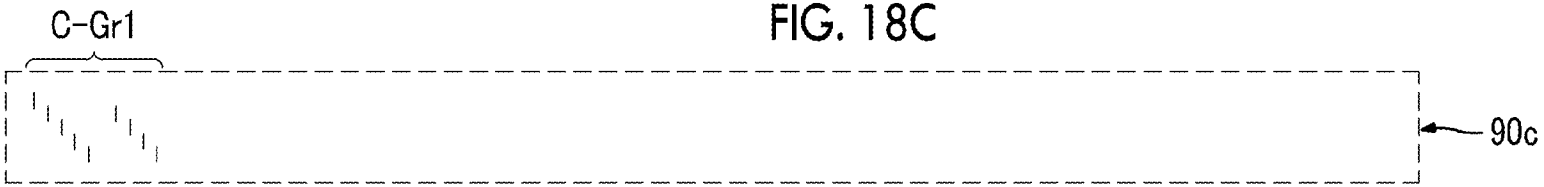

FIGS. 18A to 18C are conceptual diagrams in a case where a retest is performed in units of small groups.

FIG. 18A is a conceptual diagram illustrating the discharge unit 24C divided into first to tenth small groups C-Gr1 to C-Gr10. For example, it is assumed that an abnormality is detected in the nozzles belonging to the first small group C-Gr1 as a result of testing the group (large groups) of nozzles of cyan (C), as illustrated in FIG. 18B.

In this case, as illustrated in FIG. 18C, a test is performed on only the nozzles in the first small group C-Gr1 again. That is, a test chart 90*c* is printed using only the nozzles in the first small group C-Gr1, and retest is performed.

Thus, it is possible to suppress consumption of the ink by performing the retest using only the group (small group) to which the nozzle in which the abnormality has been detected belongs, when the retest is performed.

In the case of this example, the retest is also performed through interruption.

Further, in the case of this example, in a case where the abnormality is not detected in the retest, the retest may be performed again, as in the first modification example.

Further, although the retest is performed in units of small groups in this example, at least retest of the nozzle that is a retest target may be performed. Therefore, the retest can also be performed on only the nozzle that is a retest target.

Modification Example 3

In modification example 2, only the group (small group) to which the nozzle in which the abnormality has been detected belongs is retested. In this case, a margin can be provided in a region (margin region of the paper P) in which a test chart is printed. In this example, a test of the next group is performed using this margin region. That is, some of the nozzles in the group to be tested next are replaced with the nozzles that are the retest target without changing a basic test order, and the retest of the nozzles that are retest targets is performed. Hereinafter, a description will be given using a specific example.

Figure 19A:
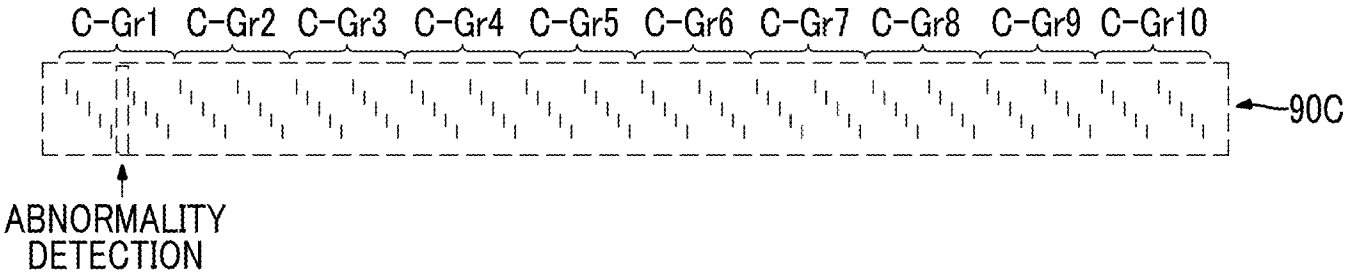
FIGS. 19A to 19C are conceptual diagrams of a process in a case where some of nozzles in a group to be tested are replaced with a nozzle that is a retest target and a retest of the nozzle that is a retest target is performed.
Figure 19B:
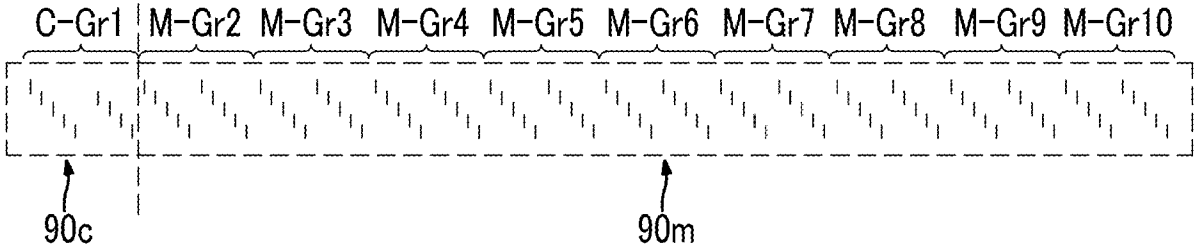
Figure 19C:
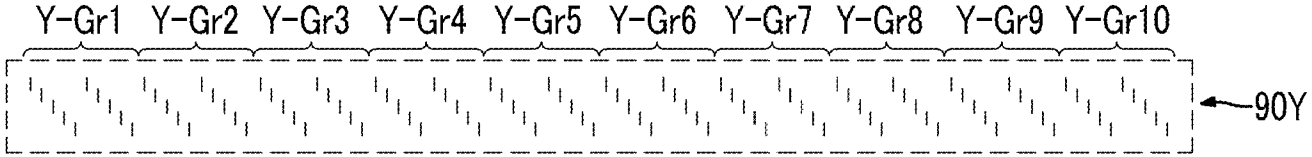

FIGS. 19A to 19C are conceptual diagrams of a process in a case where some of the nozzles in a group to be tested are replaced with nozzles that are retest targets and a retest of nozzles that are retest targets is performed.

The test is performed in a test order of cyan, magenta, yellow, and black, which corresponds to first, second, third, and fourth orders, respectively.

Here, it is assumed that an abnormality is detected in the nozzles belonging to the first small group C-Gr1 as a result of testing a group (large group) of nozzles of cyan (C), as illustrated in FIG. 19A. In this case, a retest of the nozzles of the first small group C-Gr1 is performed. A group to be tested next, that is, some of nozzles of magenta (M) are replaced with nozzles that are retest targets, and the retest is performed. Specifically, the test of the first small group M-Gr1 of magenta (M) stops, and the retest of the first small group C-Gr1 of cyan (C) is performed. As a result, the test chart of cyan (C) is printed in a part of the test chart of magenta (M) on the paper, as illustrated in FIG. 19B. More specifically, the test chart 90*c* printed in the first small group C-Gr1 of cyan (C) and the test chart 90*m* printed in the second to tenth small groups M-Gr2 to M-Gr10 of magenta (M) are printed.

Since the test order itself is not changed, if the test of magenta (M) ends, the test of the nozzle of yellow (Y) is then performed, as illustrated in FIG. 19C.

Thus, when the retest is performed, some of the nozzles in the group to be tested next are replaced with the nozzles that are retest targets, and the retest is performed. Thus, it is possible to perform the test of each group without a delay.

The retest is not necessarily performed in units of small groups, and may be performed on at least the nozzle that is a retest target.

Further, in this example, in a case where no abnormality is detected in the retest, the retest may be performed again, as in modification example 1. In this case, some of the nozzles in the next group are replaced with the nozzles that are retest targets, and the retest is performed. That is, in the above example, some of nozzles of yellow (Y) are replaced with nozzles that are retest targets of cyan (C), and the retest of the nozzles that are retest targets is performed.

Other Modification Examples

In a case where the abnormality is detected twice in the same nozzle in the above embodiment, the nozzle is recognized as an abnormal nozzle, but a condition for recognizing the abnormal nozzle is not limited thereto. For example, in a case where the abnormality is detected in the same nozzle three times, the nozzle may be recognized as an abnormal nozzle. That is, a condition of the number of abnormality detections for qualifying an abnormal nozzle may be appropriately set. In this case, the retest is performed a plurality of times through interruption.

Further, this condition can be set for each nozzle. For example, a different condition can be set for each color.

OTHER EMBODIMENTS

Application to Printer that Prints on Continuous Paper

Although the case where the present invention is applied to the printer that prints an image on the sheet has been described by way of example in the above embodiment, the application of the present invention is not limited thereto and may be similarly applied to a printer that prints an image on a strip-shaped continuous sheet (roll sheet).

Figure 20:
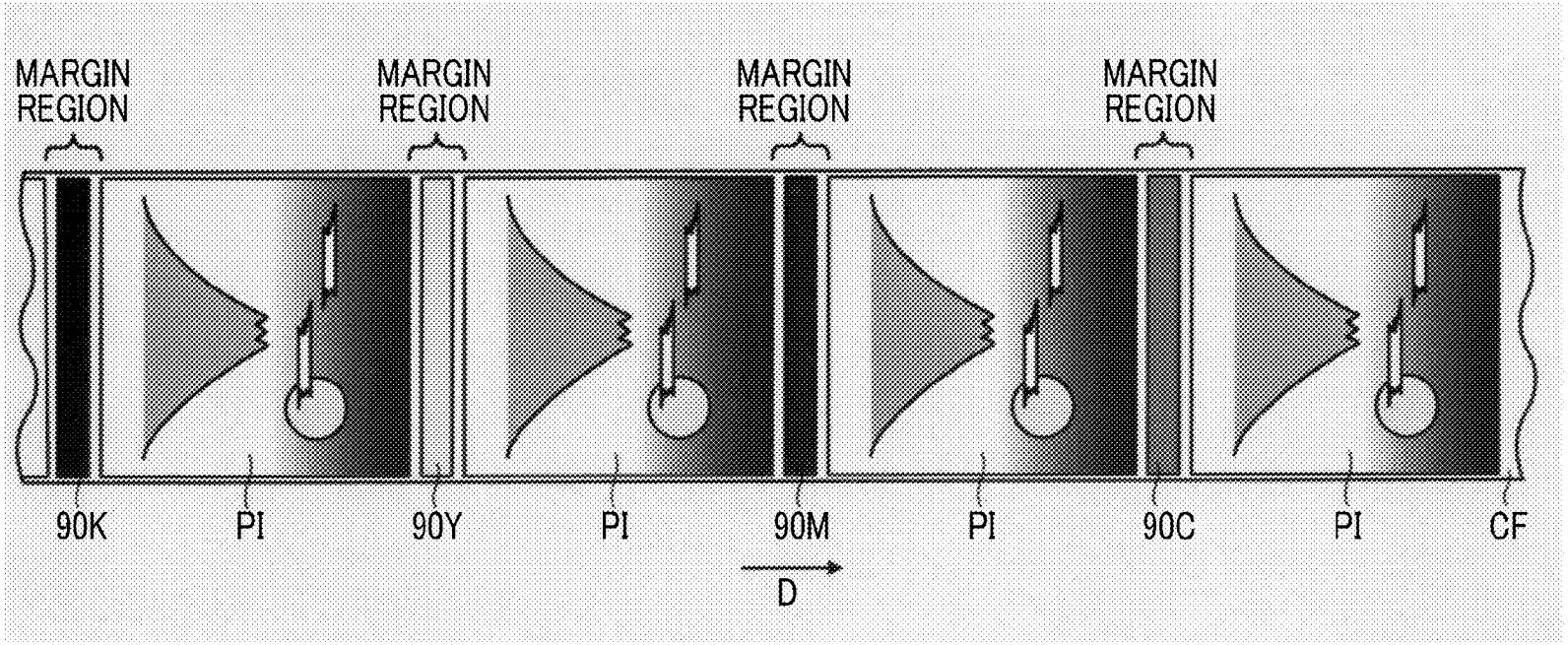
FIG. 20 is a conceptual diagram of a case where an image is printed on a continuous paper.

FIG. 20 is a conceptual diagram in a case where an image is printed on continuous paper.

As illustrated in FIG. 20, in a case where an image is printed on continuous paper CF, test charts 90C, 90M, 90Y, and 90K are printed in margin regions formed between respective images PI, and the test and the retest of the print head 22 are performed during execution of the printing job.

<Other Grouping Forms>

In the above embodiment, the nozzles included in the print head 22 are grouped for each discharge unit, that is, for each color, and the test of the nozzles is periodically performed on the group basis, but a grouping manner is not limited thereto.

For example, the nozzles of cyan and magenta may be grouped into one group, and the nozzles of yellow and black may be grouped into one group. In this case, for example, the test order may be set so that the group of cyan and magenta is first tested, and the group of yellow and black is second tested. Further, in this case, a test chart of cyan and a test chart of magenta are printed on a first paper, and a test chart of yellow and a test chart of black are printed on a second paper.

Further, for example, one discharge unit (color) may be further grouped into a plurality groups and the test order may be set. For example, the nozzles of each discharge unit may be grouped into a first group and a second group to be grouped into eight groups as a whole. In this case, for example, the test order may be set like a first group of cyan in a first order, a second group of cyan in a second order, a first group of magenta in a third order, a second group of magenta in a fourth order, a first group of yellow in a fifth order, a second group of yellow in a sixth order, a first group of black in a seventh order, and a second group of black in an eighth order. Alternatively, the test order may be set like the first group of cyan in the first order, the first group of magenta in the second order, the first group of yellow in the third order, the first group of black in the fourth order, the second group of cyan in the fifth order, the second group of magenta in the sixth order, the second group of yellow in the seventh order, and the second group of black in the eighth order.

Further, for example, in the case of a monochromatic print head (for example, a case of a monochromatic head of black only), the nozzles are grouped into odd-number nozzles and even-number nozzles, and the nozzles are tested in units of groups.

Thus, there are a variety of grouping manners, and the nozzles are appropriately grouped using a most suitable method according to, for example, a configuration of the print head.

<Method of Setting Test Order>

Any form of the test order may be adopted as long as the test is periodically performed according to a certain rule.

Although the test order is set in an order of cyan, magenta, yellow, and black in the above embodiment, the test order may be set with a difference in execution frequency. For example, for yellow, since an influence on image quality is small even in a case where an abnormality occurs in the nozzles, an execution frequency of test can be decreased in comparison with an execution frequency of test of nozzles of other colors in setting the test order. For example, the test order may be set so that the nozzles of the other colors are tested twice, whereas the nozzles of the color of yellow are tested at a rate of once. Thus, the test order may be set so that the nozzles of the colors other than yellow are tested twice, whereas the nozzles of the color of yellow are tested at a rate of once, like cyan in a first order, magenta in a second order, a yellow in a third order, black in a fourth order, cyan in a fifth order, magenta in a sixth order, and black in a seventh order.

Similarly, the test order may be set to increase an execution frequency of a test of color having a large influence on image quality. For example, the test order may be set so that a test of black is performed every other time, like cyan in a first order, black in a second order, magenta in a third order, black in a fourth order, yellow in a fifth order, black in a sixth order, cyan in a fifth order, black in a sixth order, and magenta in a seventh order.

Further, the test order may be automatically set according to a predetermined setting rule, and may be manually set by an operator.

<Timing at which Retest is Performed>

In the above embodiment, if an abnormality is detected, a retest of a group including a nozzle that is a retest target is performed through interruption immediately after the abnormality is detected. The retest is not necessarily performed immediately after the abnormality is detected. The retest may be performed before the nozzle that is a retest target is tested in a normal test order. That is, for example, in a case where grouped nozzles are tested in an order of cyan, magenta, yellow, and black, a retest of the nozzles of cyan may be performed before a test of the nozzles of cyan is performed next in a normal test order when an abnormality is detected in the nozzles of cyan. Therefore, in this case, a retest of the nozzles of cyan may be performed before at least a test of nozzles of black is performed.

Detection of an abnormal nozzle can be performed in a shorter period of time when a timing at which the retest is performed is earlier.

Application Example as Test Device that is Single Body and Method

Although the example in which the present invention is incorporated into the printer has been described as a method of testing a state of the print head during a printing job in the above embodiment, the present invention may be configured as a test device that is a single body. For example, the present invention may also be configured as a test device that tests a print head before factory shipment.

In a case where the present invention is configured as a test device that is a single body, nozzles included in a print head are grouped into a plurality of groups and tested sequentially on the group basis, and if an abnormality is detected, a retest of the group in which the abnormality is detected is performed through interruption.

Figure 21:
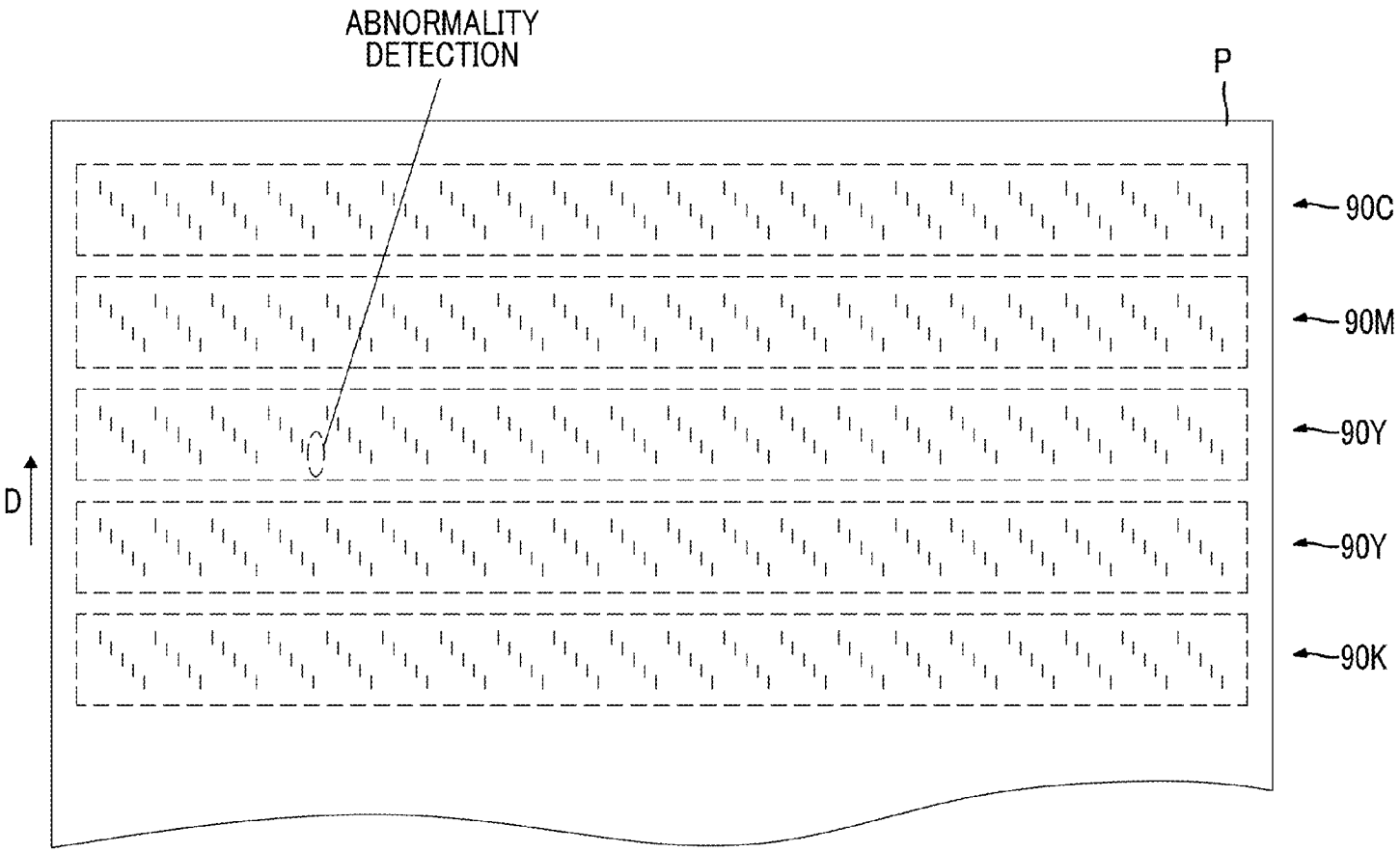
FIG. 21 is a conceptual diagram illustrating an example of a test method in a case where the present invention is configured as a test device that is a single body.

FIG. 21 is a conceptual diagram illustrating an example of a test method in a case where the present invention is configured as a test device that is a single body.

Here, an example of a method of testing a print head having discharge units of cyan, magenta, yellow, and black is shown, as in the above embodiment.

As illustrated in FIG. 21, nozzles are grouped for each color, a test chart is periodically printed on the group basis, and each nozzle is tested.

FIG. 21 illustrates an example of a case where abnormality is detected in the nozzle of yellow (Y). In this case, a retest of the nozzle of yellow is performed through interruption.

A test chart of each color may be printed on one paper, or the paper may be switched and the test chart may be printed. FIG. 21 illustrates an example in which a test chart of each color is printed on one paper.

<Application to Another Recording Type of Print Head>

The present invention effectively functions as a method of testing a print head in which recording elements are arranged in a line form or a matrix form. Therefore, even when the print head is other than an inkjet of print head, the present invention effectively functions as the test method and test device as long as recording elements are arranged in a line form or a matrix form. For example, the present invention also effectively functions as a method and device of testing a thermal type of print head in which heating elements as recording elements are arranged in a line form or a matrix form.

Further, the present invention is not limited to the line head and can also be similarly applied to a case where a serial head is tested.

Further, the recording elements are not limited to the line form and may be arranged in a matrix form, as described above.

<Test Method>

The configuration in which the test chart is printed, the result thereof is read, and a state of the nozzles is tested is adopted in the above embodiment, but the method of testing the state of the nozzles is not limited thereto. Other methods such as a method of imaging a flying state of ink discharged from a nozzle and testing a state of the nozzle or a method of imaging a nozzle surface using an electronic camera and testing a state of the nozzle may be adopted.

<Response after Abnormal Nozzle Recognition>

In the above embodiment, the configuration in which after the recognition of the abnormal nozzle, the abnormal nozzle is set to non-discharge, and the non-discharge correction process is performed to continue printing is adopted, a process after the abnormal nozzle recognition is not limited thereto. For example, a configuration in which the printing job stops and predetermined warning is performed may be adopted.

<Others>

The technical scope of the present invention is not limited to the scope described in the above embodiments. The configurations or the like in the respective embodiments may be combined appropriately between the embodiments without departing from the scope of the present invention. Further, a program to be executed by a computer for performing each embodiment is also included in the technical scope of the present invention.

EXPLANATION OF REFERENCES

1: printer
10: transport unit
12A, 12B, 12C: drum
20: printing unit
22: print head
24C, 24M, 24Y, 24K: discharge unit
26: nozzle surface
30: reading unit
32: image scanner
40: computer
42: communication unit
44: operation unit
46: display unit
48: storage unit
50: image processing unit
52: color management system (CMS) unit
54: gamma conversion unit
56: halftone processing unit
60: print head test unit
62: test order setting unit
64: test unit
66: retest target recognition unit
68: retest unit
70: abnormal nozzle recognition unit
80: non-discharge correction unit
90: test chart
90C, 90M, 90Y, 90K: test chart
90*c*, 90*m*: test chart
P: paper
N: nozzle

What is claimed is:

1. A method of testing a print head comprising a plurality of recording elements, the method comprising:

grouping the plurality of recording elements into a plurality of groups, and setting a test order of the plurality of recording elements in units of groups;

periodically performing a test of the plurality of recording elements in units of groups in the set test order;

recognizing the recording element in which an abnormality is detected, as a retest target, in a case where an abnormality is detected in at least one recording element among the plurality of recording elements in the test;

performing a retest of at least the recording element that is a retest target through interruption before a test to be performed in a test order before a change by changing the test order in a case where the recording element that is a retest target is recognized; and recognizing the recording element that is a retest target as an abnormal recording element in a case where an abnormality is detected again in the recording element that is a retest target as a result of the retest.

2. The method of testing a print head according to claim 1, further comprising:

recognizing the recording element that is a retest target, as the retest target, in a case where an abnormality is not detected again in the recording element that is a retest target as a result of the retest, and performing the retest up to a preset number of times through interruption.

3. The method of testing a print head according to claim 1, wherein the print head is an ink jet type of print head, the recording element is a nozzle included in the print head, and the abnormal recording element is recognized as an abnormal nozzle.

4. The method of testing a print head according to claim 3, wherein the test and the retest are performed by discharging ink from the nozzle to a medium and reading an image printed on the medium.

5. The method of testing a print head according to claim 3, wherein the nozzles are grouped for each color of the ink discharged from the nozzle.

6. The method of testing a print head according to claim 5, wherein the print head incorporated into a printer is tested during execution of a printing job.

7. The method of testing a print head according to claim 6, wherein the print head is a line head having a width corresponding to a width of a printing medium, the printer prints an image on the medium with a margin in a single pass, and the print head is tested during execution of a printing job by discharging ink to a margin region of the medium.

8. A printing method, comprising:

testing a print head using the method of testing a print head according to claim 3; and setting a recognized abnormal nozzle to non-discharge in a case where the abnormal nozzle is recognized, performing non-discharge correction, and printing an image on a medium.

9. A device for testing a print head comprising a plurality of recording elements, the device comprising:

a test order setting unit that groups the plurality of recording elements into a plurality of groups, and sets a test order of the plurality of recording elements in units of groups;

a test unit that periodically performs a test of the plurality of recording elements in units of groups in the test order set by the test order setting unit;

a retest target recognition unit that recognizes the recording element in which an abnormality is detected, as a retest target, in a case where an abnormality is detected in at least one recording element among the plurality of recording elements by the test unit;

a retest unit that performs a retest of at least the recording element that is a retest target through interruption before a test to be performed in a test order before a change by changing the test order in a case where the recording element that is a retest target is recognized; and an abnormal recording element recognition unit that recognizes the recording element that is a retest target as an abnormal recording element in a case where an abnormality is detected again in the recording element that is a retest target as a result of the retest in the retest unit.

10. The device for testing a print head according to claim 9, further comprising:

a second retest target recognition unit that recognizes the recording element that is a retest target, as the retest target, in a case where an abnormality is not detected again in the recording element that is a retest target again as a result of the retest in the retest unit, wherein the retest unit performs the retest up to the preset number of times through interruption.

11. The device for testing a print head according to claim 9, wherein the print head is an ink jet type of print head, the recording element is a nozzle comprised in the print head, and the abnormal recording element recognition unit is an abnormal nozzle recognition unit that recognizes the abnormal recording element as an abnormal nozzle.

12. The device for testing a print head according to claim 11, wherein the test unit causes ink to be discharged from the nozzle to a medium, and reads an image printed on the medium to test the nozzle, and the retest unit causes ink to be discharged from the nozzle to a medium, and reads an image printed on the medium to retest the nozzle.

13. The device for testing a print head according to claim 11, wherein the test order setting unit groups the nozzles for each color of ink discharged from the nozzle, and sets the test order of the nozzles in units of the groups.

14. A printer for printing an image on a medium using an inkjet type of print head comprising a plurality of nozzles, the printer comprising:

a device for testing a print head according to claim 11, wherein the print head is tested during execution of a printing job.

15. The printer according to claim 14, wherein the print head is a line head having a width corresponding to a width of a printing medium, the printer prints an image on the medium with a margin in a single pass, and the print head is tested during execution of a printing job by discharging ink to a margin region of the medium.

16. The printer according to claim 14, further comprising:

a non-discharge correction unit that sets the recognized abnormal nozzle to non-discharge and performs non-discharge correction in a case where the abnormal nozzle recognition unit recognizes the abnormal nozzle.

* * * * *